US011668147B2

(12) United States Patent
Watson et al.

(10) Patent No.: US 11,668,147 B2
(45) Date of Patent: Jun. 6, 2023

(54) CIRCULATING VALVE AND ASSOCIATED SYSTEM AND METHOD

(71) Applicant: THRU TUBING SOLUTIONS, INC., Oklahoma City, OK (US)

(72) Inventors: Brock W. Watson, Sadler, TX (US); Roger L. Schultz, Newcastle, OK (US); James C. Tucker, Springer, OK (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 135 days.

(21) Appl. No.: 17/069,646

(22) Filed: Oct. 13, 2020

(65) Prior Publication Data

US 2022/0112779 A1 Apr. 14, 2022

(51) Int. Cl.
*E21B 21/10* (2006.01)
*E21B 34/10* (2006.01)

(52) U.S. Cl.
CPC ..... *E21B 21/103* (2013.01); *E21B 34/10* (2013.01)

(58) Field of Classification Search
CPC ..... E21B 21/103; E21B 34/10
See application file for complete search history.

(56) References Cited

U.S. PATENT DOCUMENTS 2,034,768 A 3/1936 O'Neill
3,901,333 A * 8/1975 Mori ..... E21B 34/12 175/242
3,907,046 A * 9/1975 Gaylord ..... E21B 21/103 175/235
4,804,044 A 2/1989 Wesson et al.
5,335,731 A 8/1994 Ringgenberg et al.
5,529,126 A 6/1996 Edwards
(Continued)

FOREIGN PATENT DOCUMENTS

GB 2351511 A 1/2001
WO 2007055888 A1 5/2007
(Continued)

OTHER PUBLICATIONS

International Search Report with Written Opinion dated Dec. 17, 2021 for PCT Patent Application No. PCT/US2021/049346, 14 pages.
(Continued)

*Primary Examiner* — Matthew R Buck
(74) *Attorney, Agent, or Firm* — Smith IP Services, P.C.

(57) ABSTRACT

A method can include directing fluid flow longitudinally through a well tool connected in a tubular string downstream of a longitudinally compressed circulating valve assembly, thereby causing the well tool to operate, and longitudinally elongating the circulating valve assembly while the fluid flow is ceased, and then increasing the fluid flow, thereby causing the fluid flow after the elongating to pass outwardly through a housing of the circulating valve assembly to an external annulus. Another method can include directing a fluid flow through a well tool connected in a tubular string downstream of a circulating valve assembly, thereby causing the well tool to operate, and decreasing then increasing a flow rate of the fluid flow, thereby causing the fluid flow to pass outwardly through a housing assembly of the circulating valve assembly to an external annulus. Circulating valve assemblies are also disclosed.

34 Claims, 19 Drawing Sheets

(56) References Cited

U.S. PATENT DOCUMENTS

| | | | | |
|---|---|---|---|---|
| 5,890,542 | A | 4/1999 | Ringgenberg | |
| 5,901,796 | A | 5/1999 | Mcdonald | |
| 5,984,014 | A | 11/1999 | Poullard et al. | |
| 6,109,354 | A | 8/2000 | Ringgenberg et al. | |
| 6,279,657 | B1 * | 8/2001 | Carmichael | E21B 21/103 166/334.1 |
| 6,659,186 | B2 | 12/2003 | Patel | |
| 6,820,697 | B1 | 11/2004 | Churchill | |
| 7,506,704 | B2 * | 3/2009 | McGarian | E21B 21/103 175/320 |
| 8,403,067 | B2 * | 3/2013 | Knobloch, Jr. | E21B 23/006 166/334.4 |
| 8,490,702 | B2 | 7/2013 | Stromquist et al. | |
| 9,115,558 | B2 | 8/2015 | Stang | |
| 9,494,014 | B1 | 11/2016 | Manke et al. | |
| 9,890,601 | B2 * | 2/2018 | Baudoin | E21B 21/103 |
| 2004/0129423 | A1 | 7/2004 | Eddison | |
| 2004/0345707 | | 7/2004 | Eddison | |
| 2008/0047713 | A1 | 2/2008 | Henschel et al. | |
| 2008/0142219 | A1 | 6/2008 | Steele et al. | |
| 2009/0166044 | A1 | 7/2009 | Branch et al. | |
| 2009/0250224 | A1 | 10/2009 | Wright et al. | |
| 2011/0061938 | A1 | 3/2011 | Miszewski | |
| 2012/0024537 | A1 | 2/2012 | Mcdowell et al. | |
| 2012/0205108 | A1 | 8/2012 | Stang | |
| 2013/0112426 | A1 | 5/2013 | Frosell | |
| 2014/0345705 | A1 | 11/2014 | Grande et al. | |
| 2015/0068727 | A1 | 3/2015 | Hern et al. | |
| 2015/0354307 | A1 | 12/2015 | Baudoin | |
| 2016/0326834 | A1 * | 11/2016 | Manke | E21B 21/103 |

FOREIGN PATENT DOCUMENTS

| | | | | |
|---|---|---|---|---|
| WO | 2015102604 | A1 | 7/2015 | |
| WO | 2016068882 | A1 | 5/2016 | |
| WO | 2020149940 | A1 | 7/2020 | |
| WO | WO-2020249940 | A1 * | 12/2020 | E21B 21/103 |

OTHER PUBLICATIONS

Mi Swaco; "Well Commander", company brochure, dated Jul. 2014, 8 pages.

Thrutubing Solutions; "Circulating Sub", company website catalog via www.thrutubing.com, dated 2013, 8 pages.

Bico Drilling Tools; "PBL multiple Activation Autolock Bypass System", company brochure, received Apr. 7, 2015, 2 pages.

Office Action dated Nov. 4, 2022 for U.S. Appl. No. 17/748,572, 20 pages.

* cited by examiner

CIRCULATING VALVE AND ASSOCIATED SYSTEM AND METHOD

BACKGROUND

This disclosure relates generally to equipment utilized and operations performed in conjunction with a subterranean well and, in examples described below, more particularly provides for circulation of fluid into an annulus in a well.

Well operations (such as, drilling, completions, testing, etc.) are sometimes performed using a tubular string positioned in a wellbore or within another tubular, thereby forming an annulus between the tubular string and the surrounding wellbore or other tubular. Unfortunately, debris (such as drill cuttings, etc.), sand and other materials can accumulate in the annulus and impede movement of the tubular string, or impede fluid flow through the annulus.

It will, therefore, be readily appreciated that improvements are continually needed in the art of performing well operations while preventing accumulation of debris and other materials in an annulus surrounding a tubular string. The present specification provides such improvements to the art. The improvements may be used with a variety of different well operations and well configurations.

DETAILED DESCRIPTION

Figure 1:
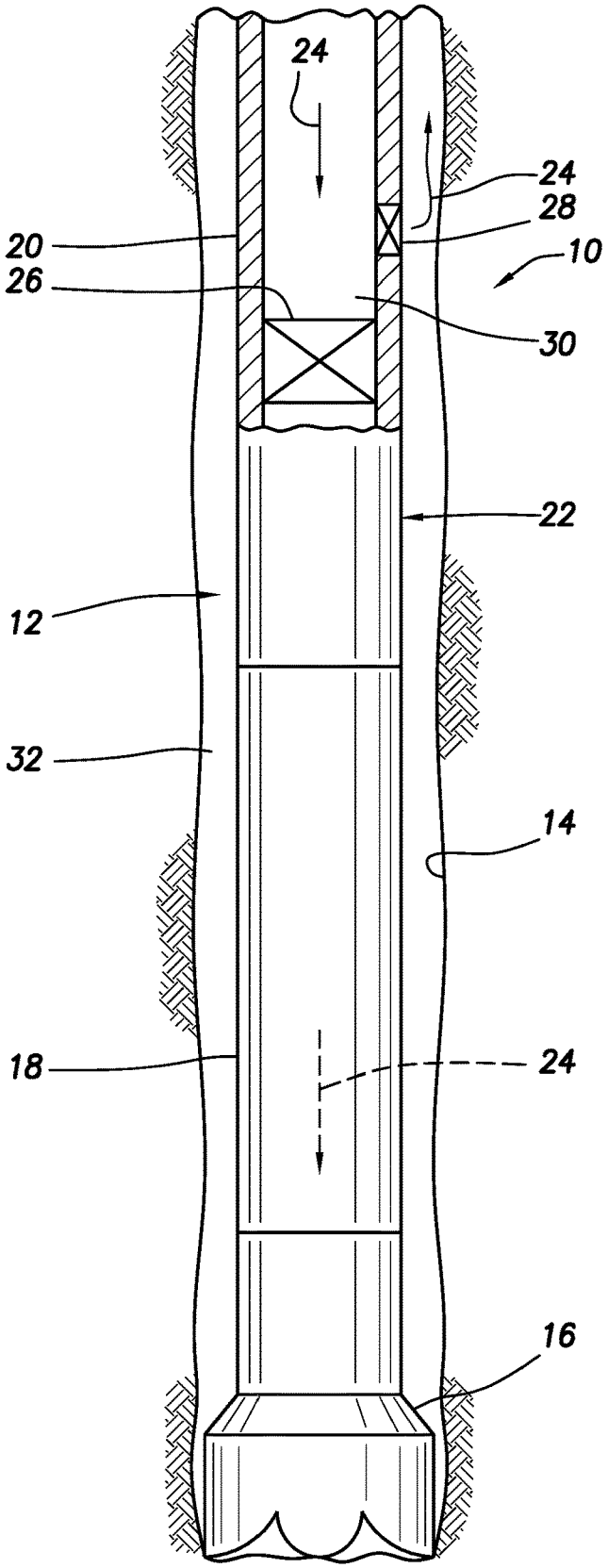
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is positioned in a wellbore 14. The tubular string 12 includes a drill bit 16, a well tool 18 and a circulating valve assembly 20 as components of a bottom hole assembly 22. The well tool 18 in this example is a fluid motor (such as, a Moineau-type positive displacement drilling motor or a turbine) that rotates the drill bit 16 in response to fluid flow 24 through the fluid motor.

In other examples, the tubular string 12 may not include the drill bit 16 or the fluid motor. For example, the tubular string 12 could be a completion or test string not used for drilling the wellbore 14. Thus, the scope of this disclosure is not limited to use of the circulating valve assembly 20 with any particular type of tubular string.

In other examples, the well tool 18 may be another type of well tool. For example, the well tool 18 could be a stabilizer, a reamer, a vibratory tool, a steering tool, a testing tool, etc. The well tool 18 may or may not operate in response to the fluid flow 24 through the well tool. The scope of this disclosure is not limited to use of any particular type of well tool with the circulating valve assembly 20.

The circulating valve assembly 20 in this example includes two valves 26, 28. The valve 26 controls the fluid flow 24 longitudinally through a flow passage 30 that extends longitudinally through the bottom hole assembly 22. The valve 26 is opened in this example when it is desired for the fluid flow 24 to pass longitudinally through the bottom hole assembly 22 to thereby operate the well tool 18 and rotate the drill bit 16.

The valve 28 controls the fluid flow 24 between the flow passage 30 and an annulus 32 external to the circulating valve assembly 20. The annulus 32 in this example is formed radially between the tubular string 12 and the wellbore 14, but in other examples the annulus may be formed between the tubular string 12 and another tubular (such as, casing, liner, tubing, etc.). The fluid flow 24 into the annulus 32 may be used to clean debris, sand, etc., from the annulus, to displace fluid in the annulus for well control, or for other purposes. The scope of this disclosure is not limited to any particular purpose or function for directing the fluid flow 24 into the annulus 32 via the valve 28.

In the FIG. 1 example, the circulating valve assembly 20 is configured so that only one of the valves 26, 28 is open at a time. Thus, when the valve 26 is open, the valve 28 is closed. When the valve 28 is open, the valve 26 is closed. In this manner, the fluid flow 24 is directed either into the flow passage 30 below the circulating valve assembly 20 (when the valve 26 is open and the valve 28 is closed), or into the annulus 32 (when the valve 28 is open and the valve 26 is closed).

Note that, as used herein, the terms "close" and "closed" are used to indicate a valve configuration in which flow through the valve is either completely prevented or only minimal flow through the valve is permitted. In the FIG. 1 example, some relatively small amount of fluid flow 24 may be permitted through the valve 26 into the bottom hole assembly 22 below the circulating valve assembly 20 when the valve 26 is closed, even though the closed valve 26 substantially blocks such flow. This substantially reduced flow through the closed valve 26 can be used to maintain some flow of fluid through the bottom hole assembly 22 below the circulating valve assembly 20.

In the FIG. 1 example, the valve 26 is opened when it is desired for the fluid flow 24 to be directed into the flow passage 30 below the circulating valve assembly 20 (e.g., to operate the well tool 18), and so the valve 26 is referred to herein as an "operator" valve. The valve 28 is opened when it is desired for all or some of the fluid flow 24 to be directed from the flow passage 30 to the annulus 32 (e.g., bypassing the bottom hole assembly 22 below the circulating valve assembly 20), and so the valve 28 is referred to herein as a "bypass" valve. However, it should be clearly understood that the scope of this disclosure is not limited to any particular effect, purpose or function of any valve, based on any term or nomenclature used to designate the valve.

Referring additionally now to FIGS. 2-6, cross-sectional views of an example of the circulating valve assembly 20 are representatively illustrated, with the circulating valve assembly being depicted in various operational configurations. The FIGS. 2-6 circulating valve assembly 20 may be used with the system 10 and method of FIG. 1, or the circulating valve assembly may be used with other systems and methods. For convenience and clarity, the circulating valve assembly 20 is further described below as it may be used in the FIG. 1 system 10 and method.

Figure 2:
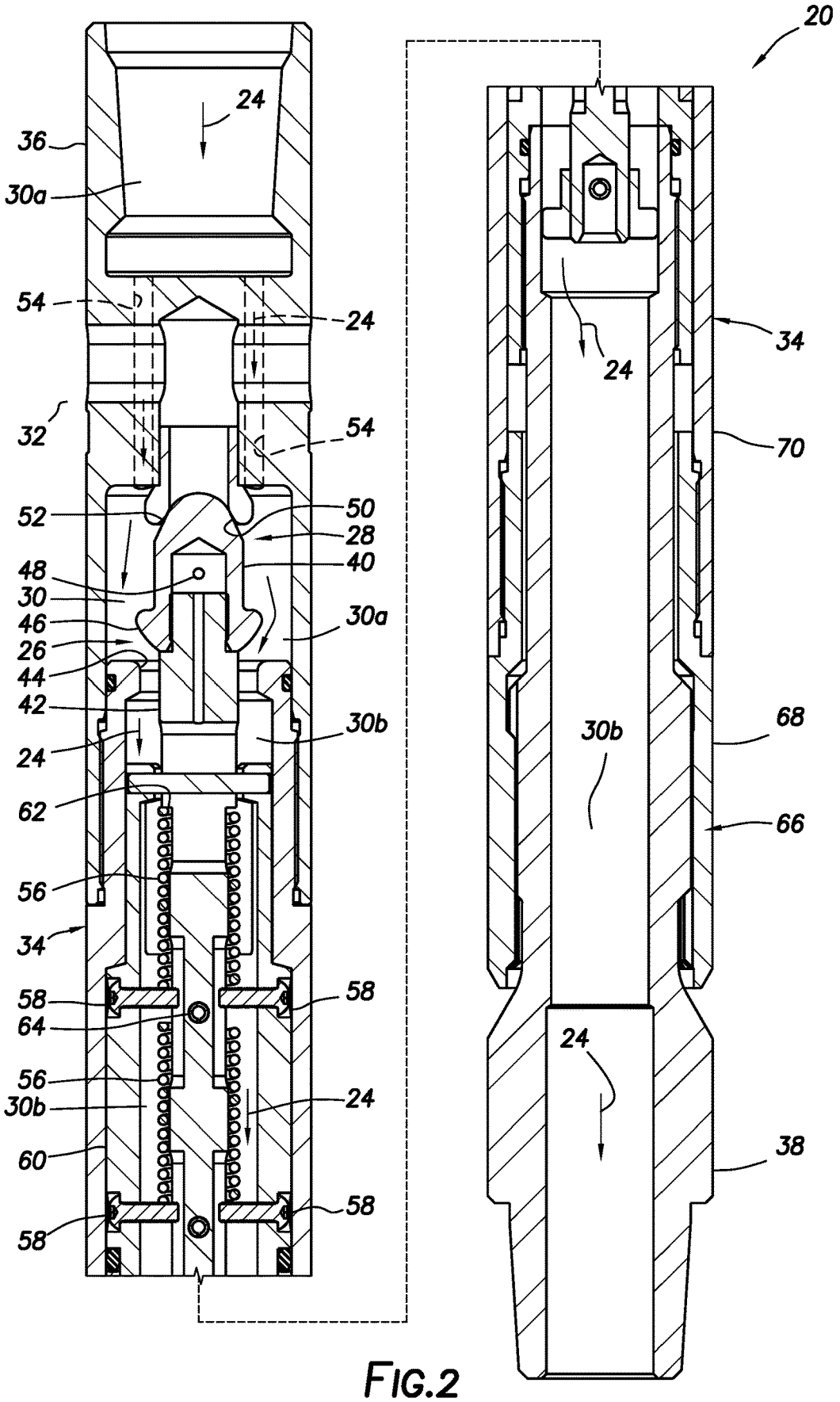
FIG. 2 is a representative cross-sectional view of an example of a circulating valve assembly that may be used in the FIG. 1 system and method, the circulating valve assembly being depicted in a compressed, operating configuration.

FIG. 2 representatively illustrates the circulating valve assembly 20 in an operating configuration, in which the fluid flow 24 passes longitudinally through the circulating valve assembly 20. The operator valve 26 is open, thereby permitting the fluid flow 24 to pass from an upper section 30*a* of the flow passage 30 to a lower section 30*b* of the flow passage. The bypass valve 28 is closed, thereby blocking the fluid flow 24 from passing into the external annulus 32 via the bypass valve.

As depicted in FIG. 2, the circulating valve assembly 20 includes a housing assembly 34 with an upper connector housing 36 and a lower connector housing 38 configured to connect the circulating valve assembly in a tubular string (such as the FIG. 1 tubular string 12) or bottom hole assembly (such as the FIG. 1 bottom hole assembly 22). In this example, the housing assembly 34 is longitudinally compressible and extendable, so that a longitudinal distance between the housings 36, 38 can be varied.

The circulating valve assembly 20 is in a longitudinally compressed configuration as depicted in FIG. 2. This configuration can be achieved by applying a longitudinally compressive force to the circulating valve assembly 20, for example, by slacking off weight on the tubular string 12 in the FIG. 1 system 10, with the bottom hole assembly 22 abutting a distal end of the wellbore 14.

The FIG. 2 compressed, operating configuration of the circulating valve assembly 20 is useful, for example, when it is desired to operate the well tool 18 with the fluid flow 24 through the lower section 30*b* of the flow passage 30. The drill bit 16 is "bottomed-out" in the wellbore 14 when weight is slacked off on the tubular string 12. In this example, the fluid flow 24 through the well tool 18 causes the drill bit 16 to rotate and thereby drill the wellbore 14.

The operator valve 26 in the FIG. 2 example includes a closure member 40 secured for reciprocating displacement with an operator mandrel 42. An annular seat 44 can be sealingly engaged with a sealing surface 46 on the closure member 40 to block the fluid flow 24 when the operator valve 26 is in a closed configuration. Thus, the operator valve 26 selectively blocks the fluid flow 24 between the flow passage sections 30*a,b*.

When the operator valve 26 is open (as depicted in FIG. 2), the fluid flow 24 can pass relatively unrestricted between the flow passage sections 30*a,b* because the closure member 40 is not sealingly engaged with the seat 44. When the operator valve 26 is closed, the fluid flow 24 between the flow passage sections 30*a,b* is blocked by sealing engagement between the closure member 40 and the seat 44. However, in the FIG. 2 example, a small opening 48 formed through the closure member 40 will permit a relatively small amount of flow therethrough when the operator valve 26 is closed.

The bypass valve 28 in the FIG. 2 example includes the closure member 40 and another annular seat 50. A sealing surface 52 formed on the closure member 40 can sealingly engage the seat 50 when the bypass valve 28 is in a closed configuration. Thus, the bypass valve 28 selectively blocks the fluid flow 24 between the flow passage section 30*a* and the exterior of the circulating valve assembly 20 (e.g., the annulus 32 in the FIG. 1 system 10).

When the bypass valve 28 is closed (as depicted in FIG. 2), the fluid flow 24 between the flow passage section 30*a* and the annulus 32 is blocked by the sealing engagement between the closure member 40 and the seat 50. When the bypass valve 28 is open, the fluid flow 24 between the flow passage section 30*a* and the annulus 32 is not blocked, since the closure member 40 is not sealingly engaged with the seat 50.

With the operator valve 26 open as depicted in FIG. 2, the fluid flow 24 can enter the upper connector housing 36, pass through multiple flow paths 54 formed through the upper connector housing, between the closure member 40 and the seat 44, and into the lower flow passage section 30*b*. The fluid flow 24 then passes into the bottom hole assembly 22 below the circulating valve assembly 20 via the lower connector housing 38.

Note that the operator mandrel 42 is biased upwardly in the FIG. 2 compressed, operating configuration. In this example, one or more compression springs or other biasing devices 56 (such as, compressible fluids, compressed gas chambers, resilient materials, etc.) are used to apply an upwardly biasing force to the operator mandrel 42. This upwardly biasing force tends to displace the closure member 40 away from the seat 44 (thus opening the operator valve 26) and toward the seat 50 (thus closing the bypass valve 28).

In the FIG. 2 example, an upper one of the biasing devices 56 is compressed between screws or other fasteners 58 extending inwardly from an inner sleeve 60 secured to the lower connector housing 38, and an external shoulder 62 formed on the operator mandrel 42. A lower one of the biasing devices 56 is compressed between additional fasteners 58 extending inwardly from the inner sleeve 60, and a pin 64 extending laterally through the operator mandrel 42. Although two of the biasing devices 56 are depicted in FIG. 2, any number of biasing devices may be used in other examples.

As mentioned above, the FIG. 2 compressed, operating configuration of the circulating valve assembly 20 may be useful in the FIG. 1 system 10 when it is desired to perform drilling operations. A compressive force can be applied to the circulating valve assembly 20 to open the operator valve 26 and close the bypass valve 28, and the fluid flow 24 can be directed through the circulating valve assembly to operate the well tool 18.

Figure 3:
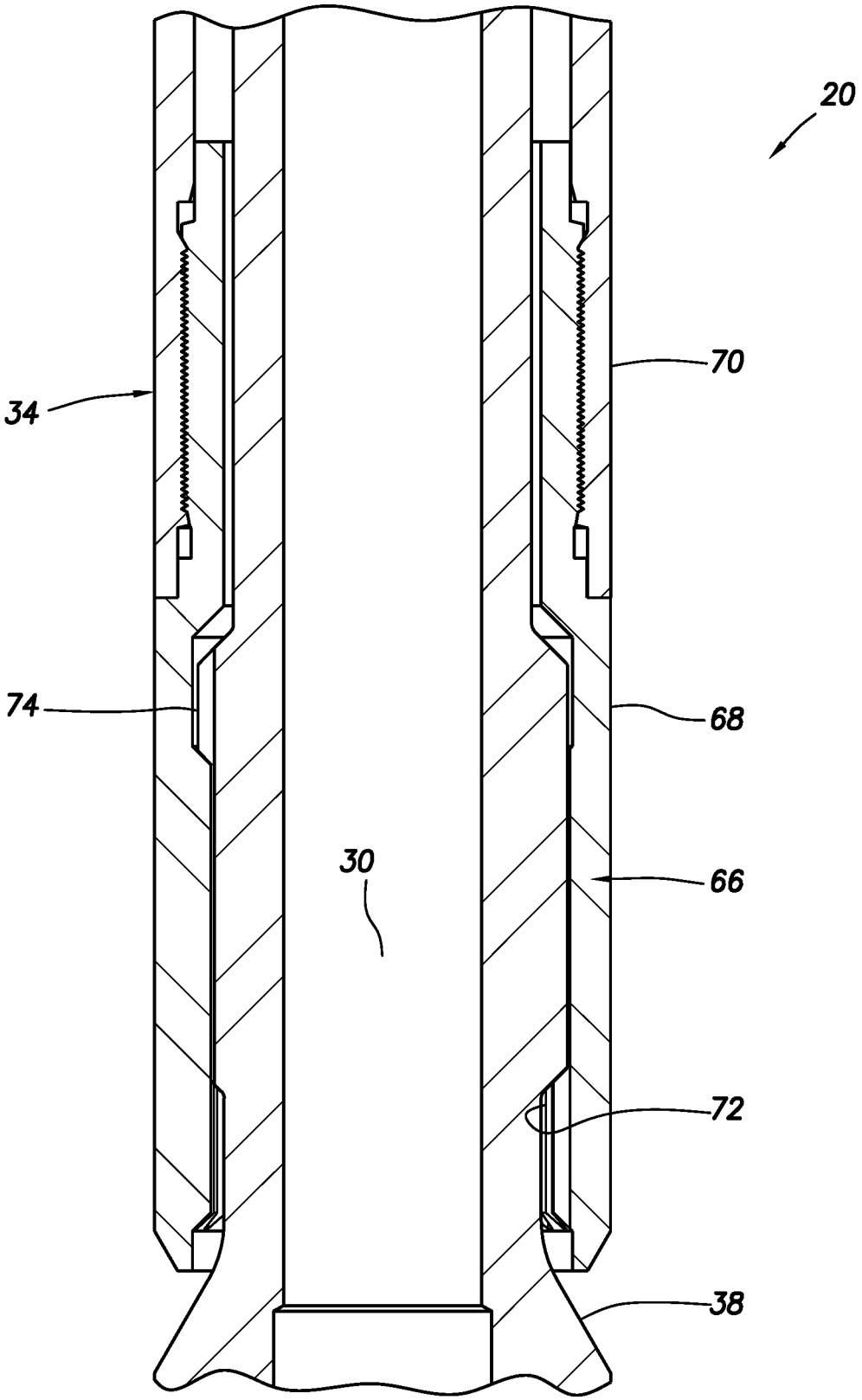
FIG. 3 is a representative cross-sectional view of an example of a splined connection of the circulating valve assembly.

Referring additionally now to FIG. 3, a longitudinally splined connection 66 of the circulating valve assembly 20 is representatively illustrated. The splined connection 66 in this example includes an outer housing 68 connected to the upper connector housing 36 via another outer housing 70. The outer housing 68 has longitudinally extending splines 72 formed therein, which slidingly engage longitudinally extending splines 74 formed on the lower connector housing 38, to thereby prevent relative rotation between the outer housing 68 and the lower connector housing 38. In this manner, the housing assembly 34 can be longitudinally compressed and elongated by application of a corresponding longitudinally compressive or tensile force to the housing assembly.

Figure 4:
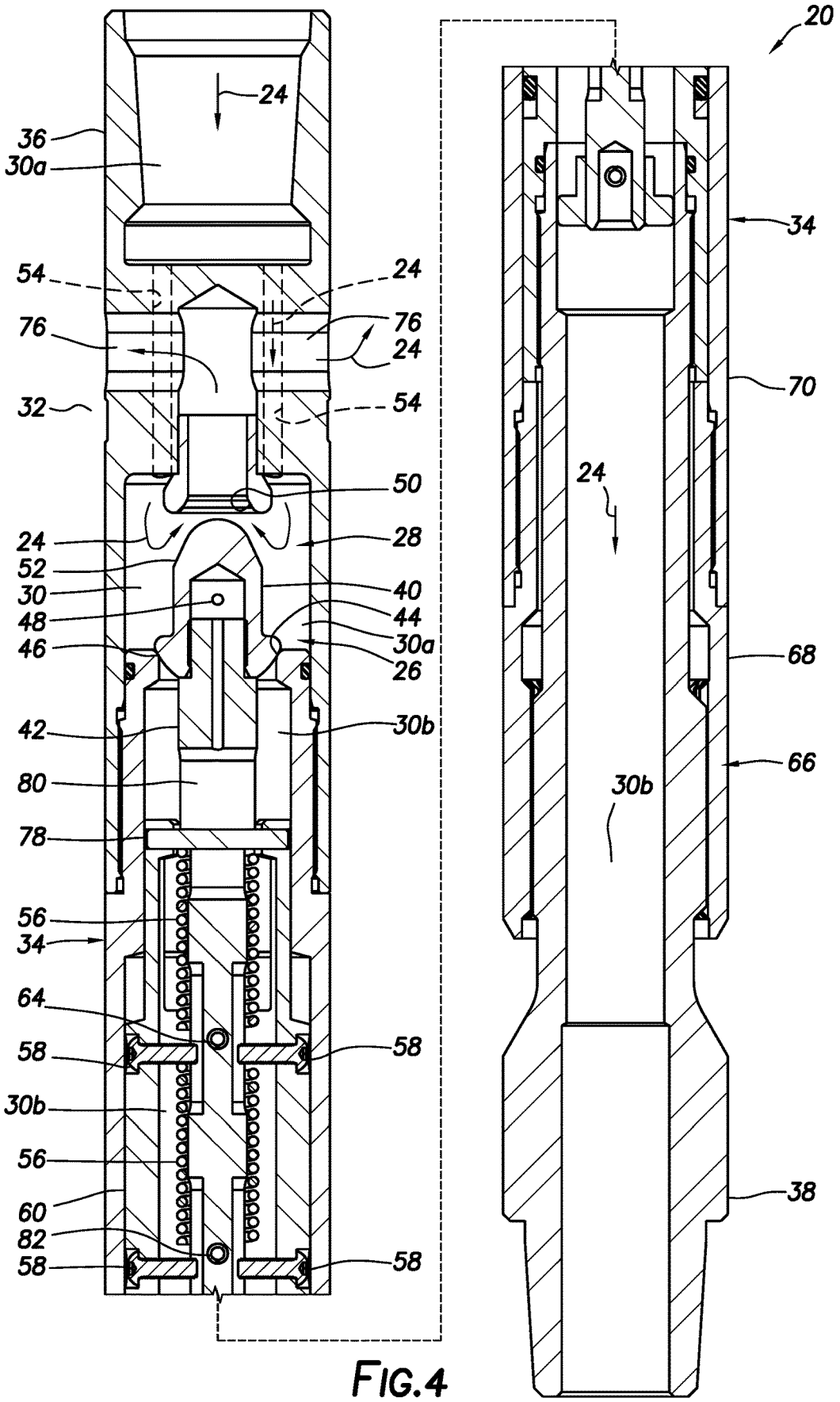
FIG. 4 is a representative cross-sectional view of the circulating valve assembly in an elongated, bypass configuration.

Referring additionally now to FIG. 4, the circulating valve assembly 20 is representatively illustrated in an elongated, bypass configuration. In this configuration, a tensile longitudinal force is applied to the circulating valve assembly 20, the operator valve 26 is closed (thereby blocking flow between the flow passage sections 30*a,b*) and the bypass valve 28 is open (thereby permitting the fluid flow 24 to pass from the upper flow passage section 30*a* to the annulus 32 via ports 76 formed through a sidewall of the upper connector housing 36).

Due to the elongation of the housing assembly 34, the operator mandrel 42 and the closure member 40 are now biased in a downward direction by the biasing devices 56. Note that the upper biasing device 56 is now longitudinally compressed between the pin 64 and another pin 78 extending laterally through an upper end of the inner sleeve 60 and received in a longitudinally extending slot 80 in the operator mandrel 42. The lower biasing device 56 is longitudinally compressed between the upper fasteners 58 and another pin 82 extending laterally through the operator mandrel 42.

Thus, the biasing devices 56 now bias the operator mandrel 42 and the closure member 40 to a bypass position in which the operator valve 26 is closed and the bypass valve 28 is open. The closure device sealing surface 46 now sealingly engages the seat 44, thereby blocking the fluid flow 24 from the upper flow passage section 30*a* to the lower flow passage section 30*b* (although a relatively small amount of the fluid flow is permitted to pass through the opening 48), and the closure device sealing surface 52 does not sealingly engage the seat 50, thereby permitting the fluid flow 24 from the upper flow passage section 30*a* to the external annulus 32 via the ports 76. In other examples, the opening 48 may not be provided in the closure member 40, so that the fluid flow 24 between the flow passage sections 30*a,b* is entirely prevented in the bypass configuration.

The FIG. 4 bypass configuration may be useful in the FIG. 1 system when it is desired to flush debris, sand, etc., from the annulus 32 or to displace fluid in the annulus, by directing the fluid flow 24 (or at least most of the fluid flow) into the annulus, thereby bypassing the bottom hole assembly 22 downstream of the circulating valve assembly 20. In some examples, much higher flow rates of the fluid flow 24 may be used in the bypass configuration as compared to the operating configuration, since components of the bottom hole assembly 22 downstream of the circulating valve assembly 20 may have flow rate or pressure rating limitations that prohibit use of such high flow rates through those components. The higher flow rates provide for more effective flushing of debris, sand, etc., from the annulus 32 and provide for more effective displacement of fluid in the annulus.

The FIG. 4 bypass configuration can be achieved by longitudinally elongating the circulating valve assembly 20 while there is no or minimal fluid flow 24, and then directing the fluid flow through the flow passage 30. The elongation of the housing assembly 34 causes the operator valve 26 to close, and causes the bypass valve 28 to open, as described above.

Figure 5:
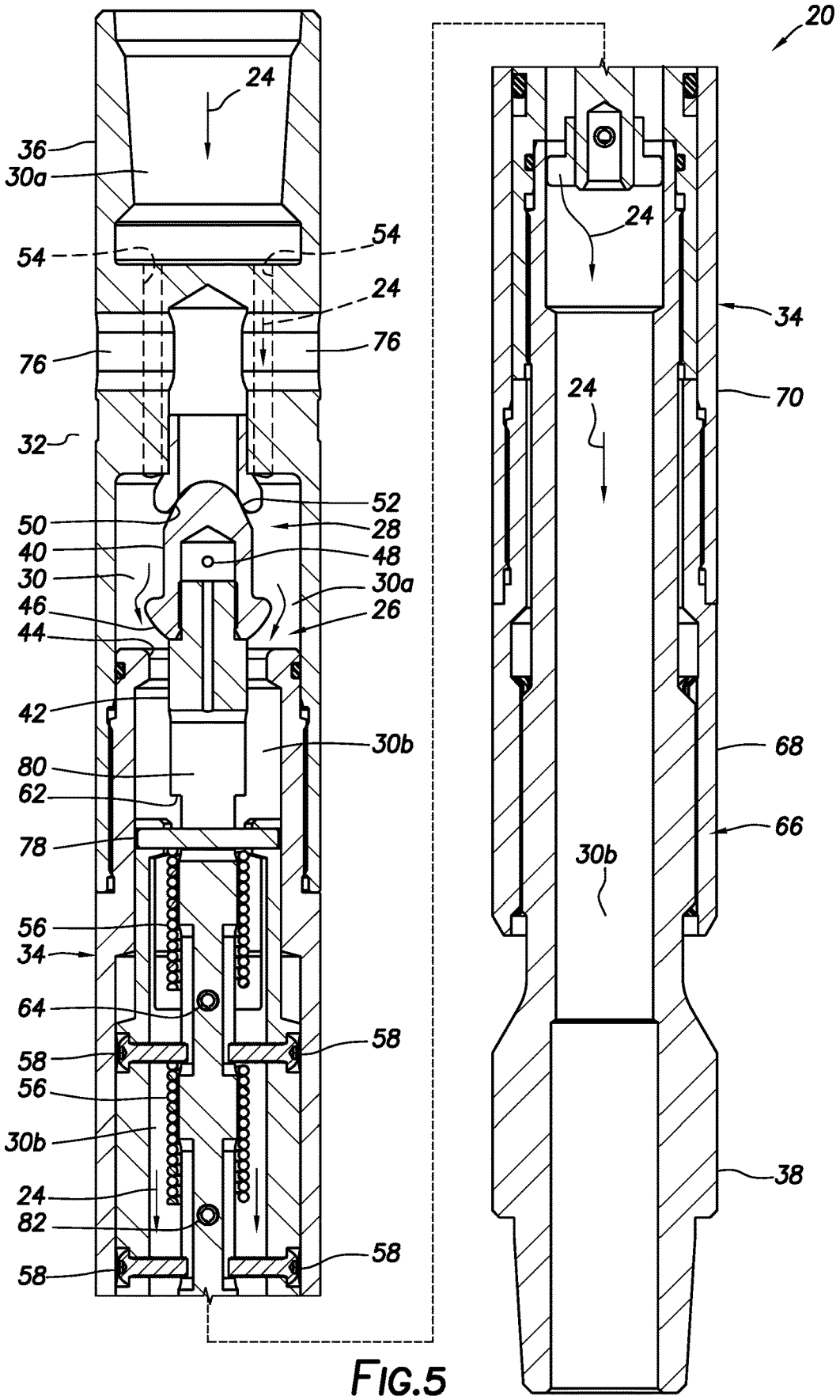
FIG. 5 is a representative cross-sectional view of the circulating valve assembly in an elongated, operating configuration.

Referring additionally now to FIG. 5, the circulating valve assembly 20 is representatively illustrated in an elongated, operating configuration. The operator valve 26 is open in this configuration, thereby permitting relatively unobstructed fluid flow 24 between the upper flow passage section 30*a* and the lower flow passage section 30*b*. The bypass valve 28 is closed, thereby preventing the fluid flow 24 from the upper flow passage section 30*a* to the external annulus 32.

The FIG. 5 elongated, operating configuration may be useful in the FIG. 1 system when it is desired to operate the well tool 18, or to otherwise permit substantial fluid flow 24 through the bottom hole assembly 22 downstream of the circulating valve assembly 20, while applying a longitudinally tensile force to the circulating valve assembly (for example, when pulling the tubular string 12 out of the wellbore 14). Beginning with the circulating valve assembly 20 in the compressed, operating configuration of FIG. 2, the FIG. 5 elongated, operating configuration may be achieved by applying the longitudinally tensile force to the circulating valve assembly while the fluid flow 24 is maintained.

Note that, with the housing assembly 34 elongated as depicted in FIG. 5, the biasing devices 56 exert a downwardly directed biasing force on the operator mandrel 42 (e.g., biasing the closure member 40 toward closing the operator valve 26 and opening the bypass valve 28). However, a pressure differential across the bypass valve 28 acts to maintain the bypass valve closed, as long as the fluid flow 24 continues.

In this example, the biasing devices 56 are selected so that only a nominal amount of the fluid flow 24 (such as, two barrels per minute) is required to maintain the bypass valve 28 closed and the operator valve 26 open (due to the pressure differential across the bypass valve) while the longitudinally tensile force is applied to elongate the circulating valve assembly 20. Other flow rates and other criterion for selecting the biasing devices 56 may be used in other examples.

Figure 6:
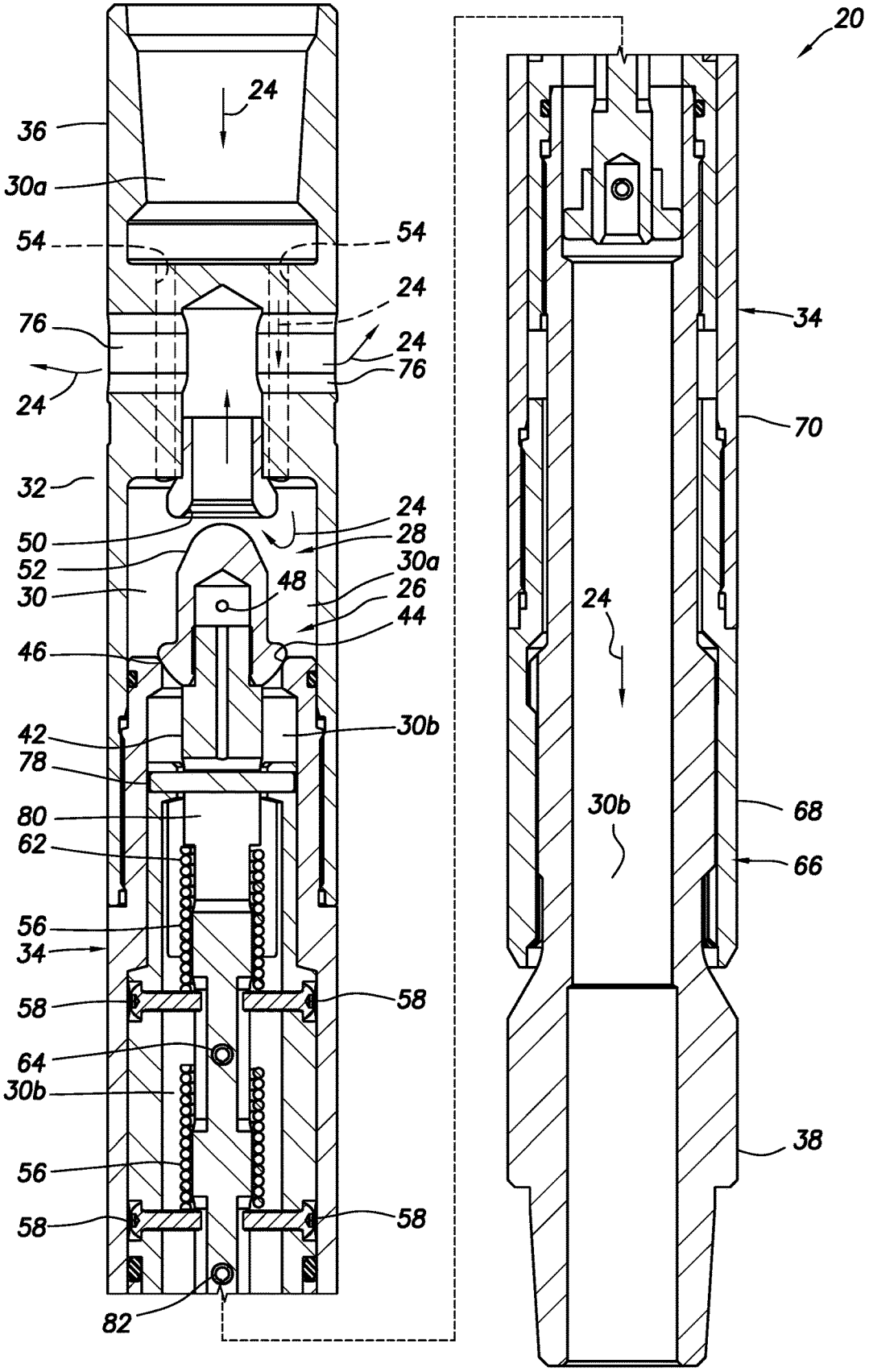
FIG. 6 is a representative cross-sectional view of the circulating valve assembly in a compressed, bypass configuration.

Referring additionally now to FIG. 6, the circulating valve assembly 20 is representatively illustrated in a compressed, bypass configuration. The operator valve 26 is closed in this configuration, thereby blocking fluid flow 24 between the upper flow passage section 30*a* and the lower flow passage section 30*b*. The bypass valve 28 is open, thereby permitting the fluid flow 24 from the upper flow passage section 30*a* to the external annulus 32.

Beginning with the circulating valve assembly 20 in the elongated, bypass configuration of FIG. 4, the FIG. 6 compressed, bypass configuration may be achieved by applying a longitudinally compressive force to the circulating valve assembly while the fluid flow 24 is maintained.

Note that, with the housing assembly 34 longitudinally compressed as depicted in FIG. 6, the biasing devices 56 exert an upwardly directed biasing force on the operator mandrel 42 (e.g., biasing the closure member 40 toward opening the operator valve 26 and closing the bypass valve 28). However, a pressure differential across the operator valve 26 acts to maintain the operator valve closed and the bypass valve 28 open, as long as the fluid flow 24 continues.

Referring additionally now to FIGS. 7-12, another example of the circulating valve assembly 20 is representatively illustrated. Components of the FIGS. 7-12 circulating valve assembly 20 that are similar to those described above for the FIGS. 2-6 example are indicated in FIGS. 7-12 using the same reference numbers.

The FIGS. 7-12 circulating valve assembly 20 differs substantially from the FIGS. 2-6 example, in that each of the operator and bypass valves 26, 28 is provided with a separate, respective closure member 40*a,b*, and an index mechanism 84 is used to control a longitudinal position of a flow restrictor 86 relative to the operator mandrel 42. The closure members 40*a,b* are secured at respective opposite ends of the operator mandrel 42. The biasing device 56 continually biases the operator mandrel 42 upward toward an operating position in which the operator valve 26 is open and the bypass valve 28 is closed.

Figure 7:
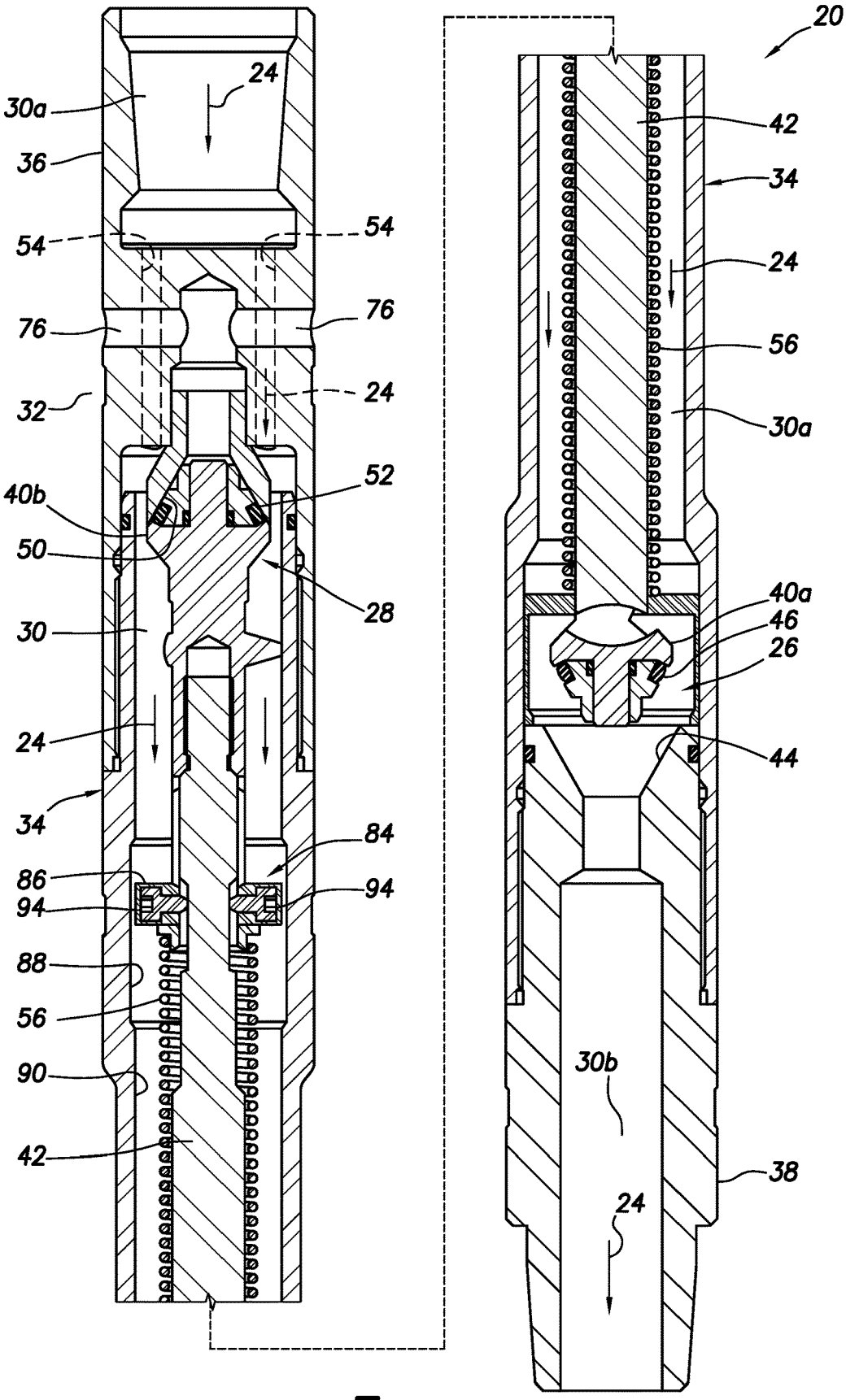
FIG. 7 is a representative cross-sectional view of another example of the circulating valve assembly, the circulating valve assembly being depicted in a run-in, operating configuration.

As depicted in FIG. 7, the circulating valve assembly 20 is in a run-in, operating configuration. The operator valve 26 is open (the seat 44 is spaced apart from the sealing surface 46 of the closure member 40*a*) and the bypass valve 28 is closed (the seat 50 is sealingly engaged by the sealing surface 52 of the closure member 40*b*). The fluid flow 24 can pass longitudinally through the flow passage 30 between the upper and lower sections 30*a,b*.

Note that, in the FIGS. 7-12 example, each of the sealing surfaces 46, 52 is separable from the respective closure member 40*a,b*. Specifically, the sealing surfaces 46, 52 are on o-rings or other types of seals carried on the closure members 40*a,b*. In other examples, other types of sealing surfaces may be used with the closure members 40*a,b*.

As depicted in FIG. 7, the flow restrictor 86 is positioned in a radially enlarged recess 88 formed in the housing assembly 34. In this position, there is an annular flow area for the fluid flow 24 radially between the flow restrictor 86 and the recess 88. If the flow restrictor 86 is displaced downward relative to the housing assembly 34 (as described more fully below), so that the flow restrictor is positioned in a radially reduced bore 90 of the housing assembly, the annular flow area of the flow passage 30 between the flow restrictor and the housing assembly will be reduced.

When the flow area is reduced (e.g., when the flow restrictor 86 is positioned in the bore 90), a pressure differential across the flow restrictor 86 due to the fluid flow 24 is increased. Conversely, when the flow area is increased (e.g., when the flow restrictor 86 is positioned in the recess 88), the pressure differential across the flow restrictor 86 due to the fluid flow 24 is reduced.

In the FIG. 7 run-in configuration, a flow rate of the fluid flow 24 may or may not be sufficient to operate the well tool 18 in the FIG. 1 system. However, note that it is not necessary for the fluid flow 24 to be used while the tubular string 12 is being run into the wellbore 14.

As depicted in FIG. 7, the pressure differential across the flow restrictor 86 due to the fluid flow 24 is not sufficient to downwardly displace the flow restrictor against the biasing force exerted by the biasing device 56. When it is desired to switch the circulating valve assembly 20 to its bypass configuration, the flow rate of the fluid flow 24 can be increased to thereby increase the pressure differential across the flow restrictor 86 (thereby causing the flow restrictor to displace downward relative to the operator mandrel 42), and then the flow rate can be decreased as described more fully below.

Figure 8:
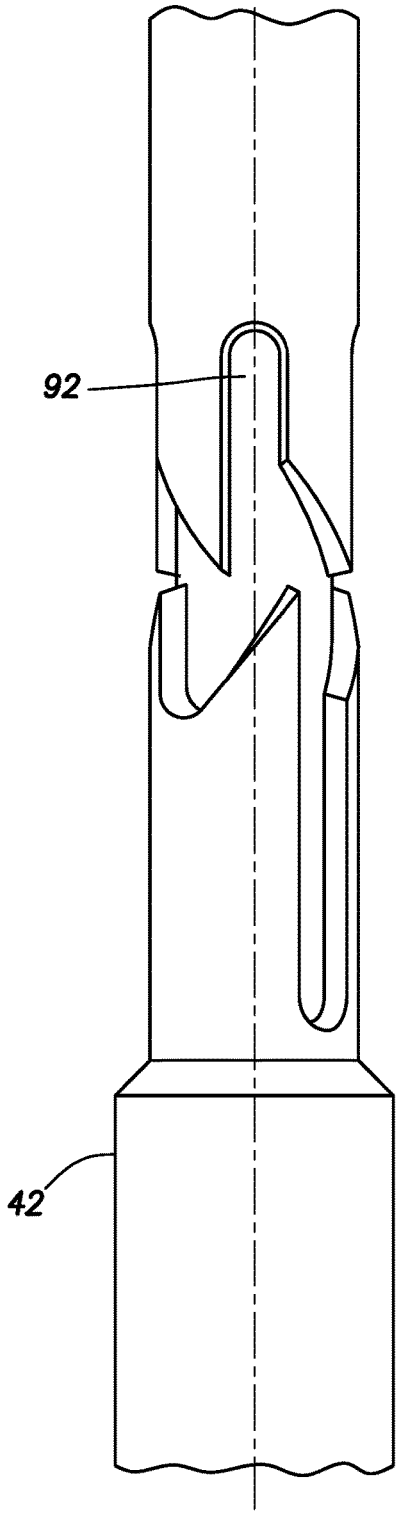
FIG. 8 is a representative side view of an example of an operator mandrel of the FIG. 7 circulating valve assembly.

Referring additionally now to FIG. 8, a side view of a section of the operator mandrel 42 is representatively illustrated, apart from the remainder of the circulating valve assembly 20. In this view, an index profile 92 formed on the operator mandrel 42 can be more clearly seen. The index profile 92 is of the type known to those skilled in the art as a "J-slot," since portions of the profile are similar in shape to the letter "J." However, other types of index profiles may be used in other examples.

Threaded pins 94 (see FIG. 7) extend inward from the flow restrictor 86 into the index profile 92. Any number of pins 94 may be used in other examples. In the FIG. 8 example, the index profile 92 includes two sets of continuous J-slots extending about the operator mandrel 42 to correspond with the two pins 94.

Figure 8A:
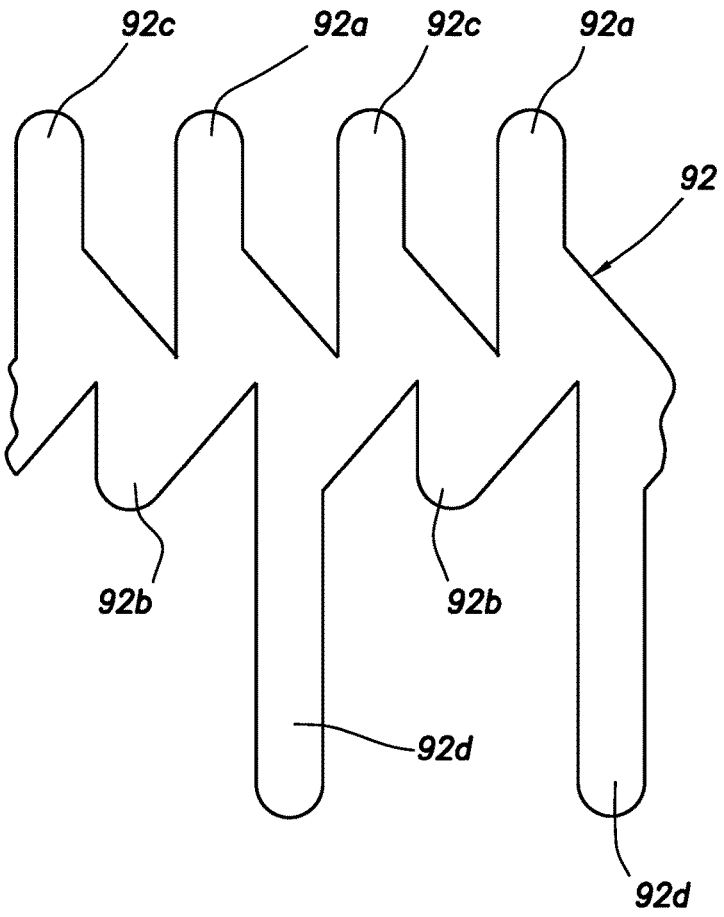
FIG. 8A is a representative flattened side view of an example of an index profile of the operator mandrel.

In FIG. 8A, the index profile 92 is depicted in a rolled-out or "flattened" view. The pins 94 are positioned in respective upper legs 92*a* of the profile 92 when the circulating valve assembly 20 is in the FIG. 7 run-in configuration.

As described more fully below, the pins 94 will displace downward to respective lower legs 92*b* of the profile 92 when the flow rate of the fluid flow 24 is increased (the flow restrictor 86 displaces downward against the biasing force of the biasing device 56 when the pressure differential across the flow restrictor increases). When the flow rate is subsequently decreased, the pins 94 will displace upward to respective upper legs 92*c* of the profile 92 (the flow restrictor 86 is displaced upward by the biasing force of the biasing device 56 when the pressure differential across the flow restrictor decreases). When the flow rate is subsequently increased, the pins 94 will displace downward to respective lower legs 92*d* of the profile 92 (the flow restrictor 86 displaces downward against the biasing force of the biasing device 56 when the pressure differential across the flow restrictor increases). When the flow rate is subsequently decreased, the pins 94 will displace upward to respective upper legs 92*a*, and this sequence repeats.

Note that the lower legs 92*d* are substantially longer than the lower legs 92*b*. When the pins 94 are positioned in the lower legs 92*d*, the flow restrictor 86 is positioned in the radially reduced bore 90, and so the flow area for the fluid flow 24 between the flow restrictor and the housing assembly 34 is substantially reduced, and the pressure differential across the flow restrictor due to the fluid flow is substantially increased.

Figure 9:
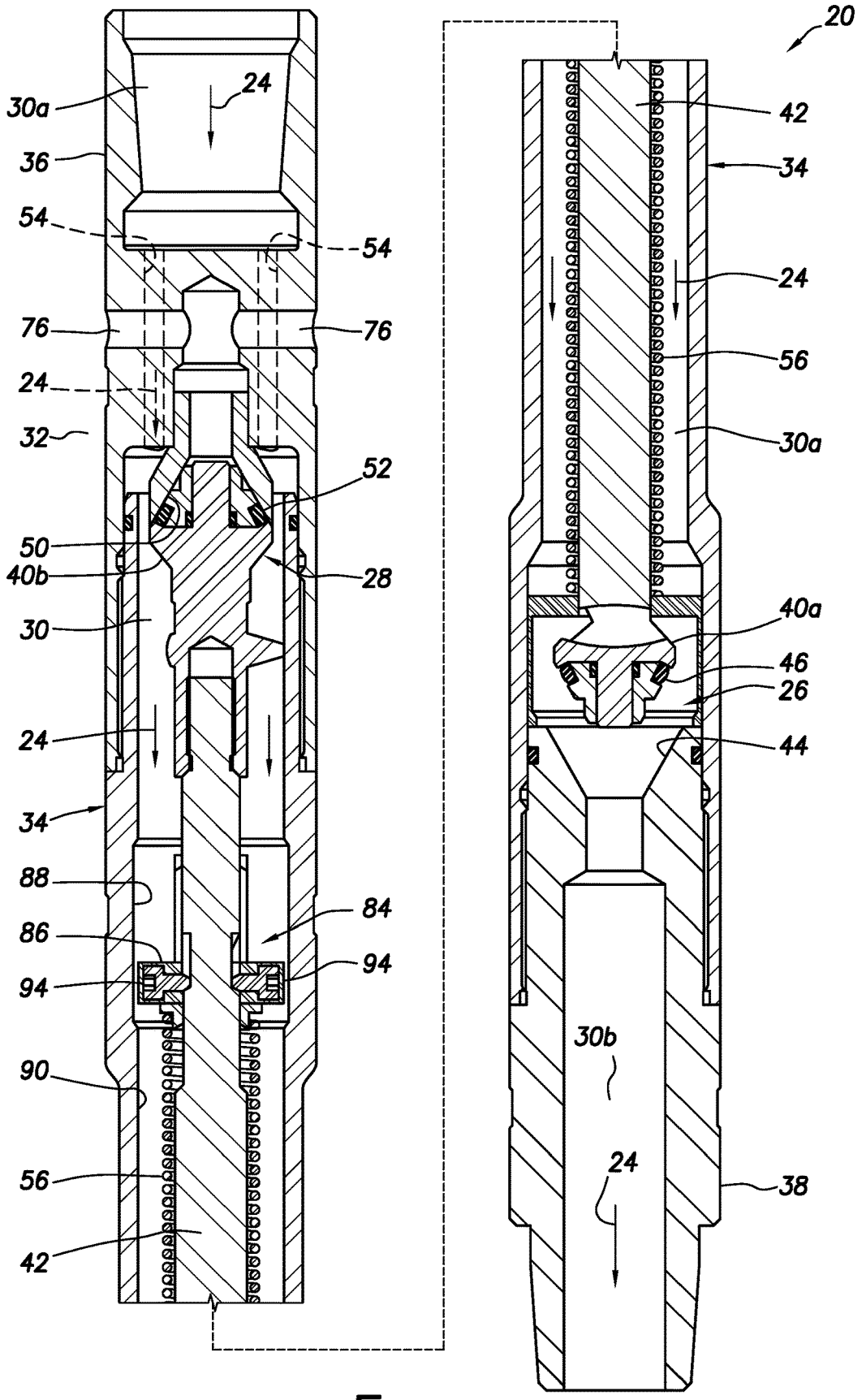
FIG. 9 is a representative cross-sectional view of the circulating valve assembly in an operating configuration.

Referring additionally now to FIG. 9, the circulating valve assembly 20 is representatively illustrated in an operating configuration, in which the flow rate of the fluid flow 24 has been increased. The increased flow rate has increased the pressure differential across the flow restrictor 86 due to the fluid flow 24. As a result, the flow restrictor 86 has displaced downward relative to the operator mandrel 42 against the biasing force exerted by the biasing device 56, and the pins 94 are now positioned in the lower legs 92*b* of the index profile 92.

The bypass valve 28 remains closed. A pressure differential across the bypass valve 28 due to the fluid flow 24 helps to maintain the bypass valve in its closed configuration. The operator valve 26 remains open, so the fluid flow 24 can pass to the well tool 18 in the bottom hole assembly 22 downstream of the circulating valve assembly 20 in the FIG. 1 system 10.

If the flow rate of the fluid flow 24 is subsequently decreased sufficiently for the biasing device 56 to displace the flow restrictor 86 upward relative to the operator mandrel 42, then the pins 94 will displace to the upper legs 92*c* of the profile 92. This configuration of the circulating valve assembly 20 will be essentially the same as the FIG. 7 configuration, except for the pins 94 being in the upper legs 92*c* (rather than the upper legs 92*a*) of the profile 92.

If the flow rate of the fluid flow 24 is then (after the flow rate decrease that positions the pins in the upper legs 92*c* of the profile 92) increased sufficiently for the pressure differential across the flow restrictor 86 to overcome the biasing force exerted by the biasing device 56, the flow restrictor 86 will displace downward relative to the operator mandrel 42. This configuration is depicted in FIG. 10.

Figure 10:
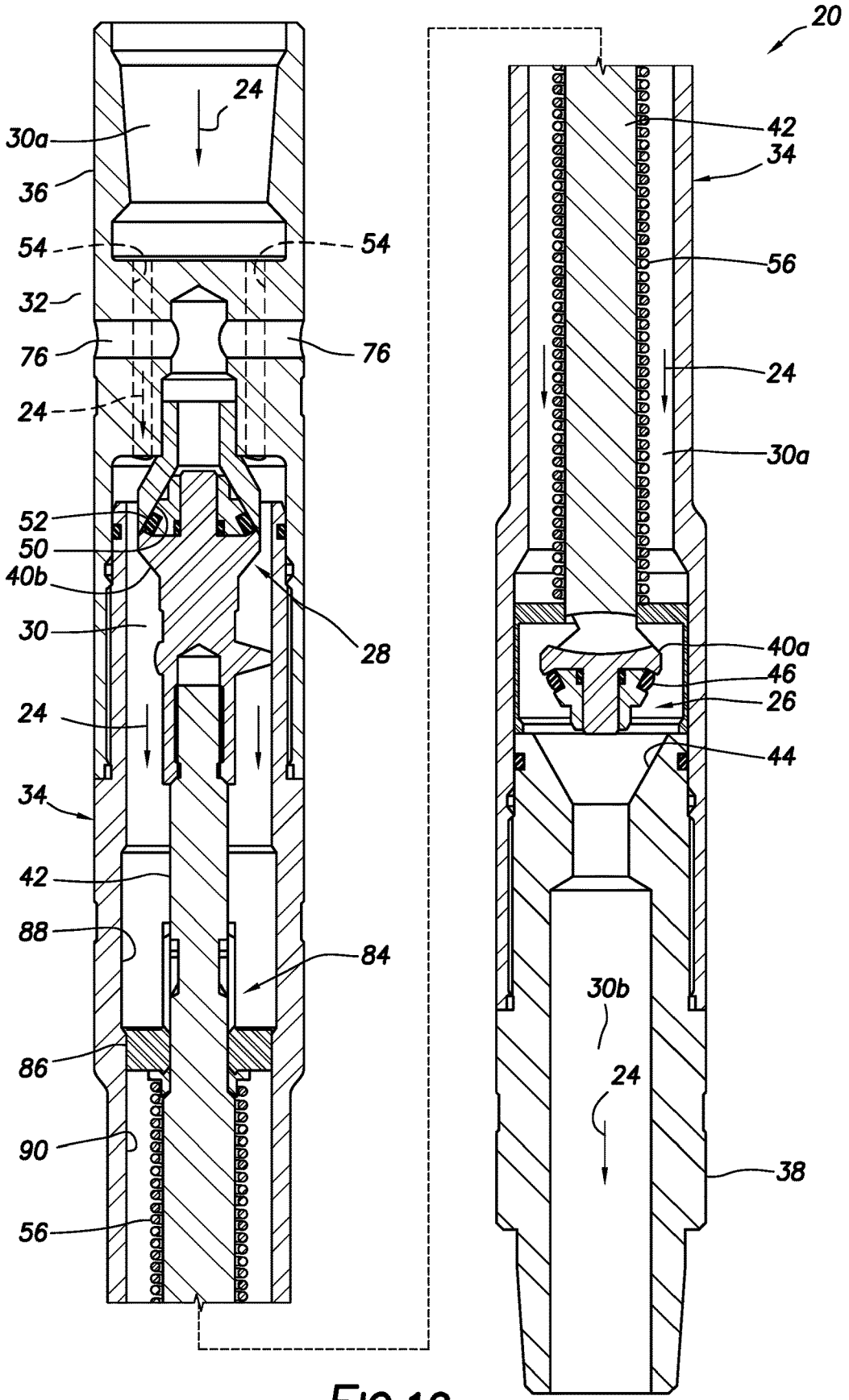
FIG. 10 is a representative cross-sectional view of the circulating valve assembly in an indexed, increased flow rate configuration.

In the FIG. 10 configuration, the pins 94 are positioned in the longer lower legs 92*d* of the profile 92. As a result, the flow restrictor 86 is now positioned in the radially reduced bore 90, thereby reducing the flow area for the fluid flow 24 between the flow restrictor and the bore, and increasing the pressure differential across the flow restrictor. This helps to reduce or mitigate oscillation of the operator mandrel 42 in the bypass configuration.

Figure 11:
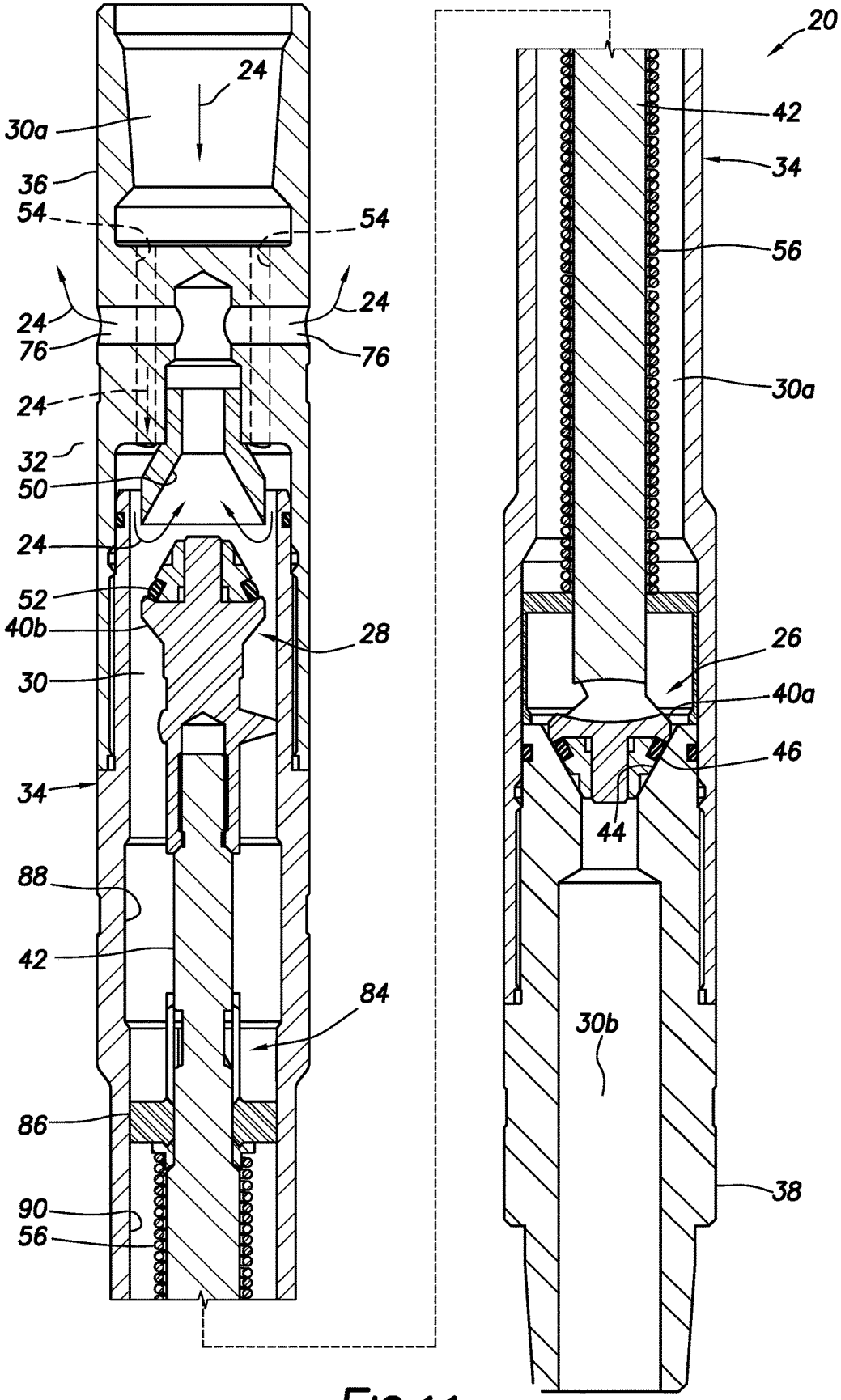
FIG. 11 is a representative cross-sectional view of the circulating valve assembly in a bypass configuration.

Referring additionally now to FIG. 11, the circulating valve assembly 20 is representatively illustrated in the bypass configuration. This configuration is achieved as a result of the increased pressure differential across the flow restrictor 86 caused by the increased flow rate that caused the flow restrictor to displace downward into the bore 90 as described above.

The increased pressure differential across the flow restrictor 86 causes the flow restrictor 86 to displace downward with the operator mandrel 42 against the biasing force exerted by the biasing device 56. The closure members 40*a,b* displace downward with the operator mandrel 42.

In the FIG. 11 bypass configuration, the bypass valve 28 is open, thereby permitting the fluid flow 24 to pass outward from the upper flow passage section 30*a* and through the ports 76 to the external annulus 32. The operator valve 26 is closed, thereby blocking the fluid flow 24 from the upper flow passage section 30*a* to the lower flow passage section 30*b*.

The bypass configuration of FIG. 11 may be useful in the FIG. 1 system 10 and method when it is desired to flush the annulus 32 of debris, sand, etc., or to displace fluid from the annulus. Note that only a decrease in flow rate of the fluid flow 24, followed by an increase in the flow rate, is required to switch the circulating valve assembly 20 from the operating configuration of FIG. 9 to the bypass configuration of FIG. 11. Similarly, only a decrease in flow rate of the fluid flow 24, followed by an increase in the flow rate, is required to switch the circulating valve assembly 20 from the bypass configuration of FIG. 11 back to the operating configuration of FIG. 9.

In this example, the profile 92 is configured so that only a single set of a flow rate decrease (e.g., so that the flow rate is less than a predetermined level) followed by a flow rate increase (e.g., so that the flow rate is greater than the predetermined level) is required to switch the circulating valve assembly 20 from the bypass to the operating configuration, or from the operating configuration to the bypass configuration. The predetermined level is determined, in this example, by the biasing force exerted by the biasing devices 56, and the position of the flow restrictor 86 relative to the recess 88 and bore 90. In other examples, the profile 92 may be configured to require multiple sets of flow rate decreases and increases, or to require a different number of flow rate increases than the number of flow rate decreases, to switch between configurations of the circulating valve assembly 20.

Figure 12:
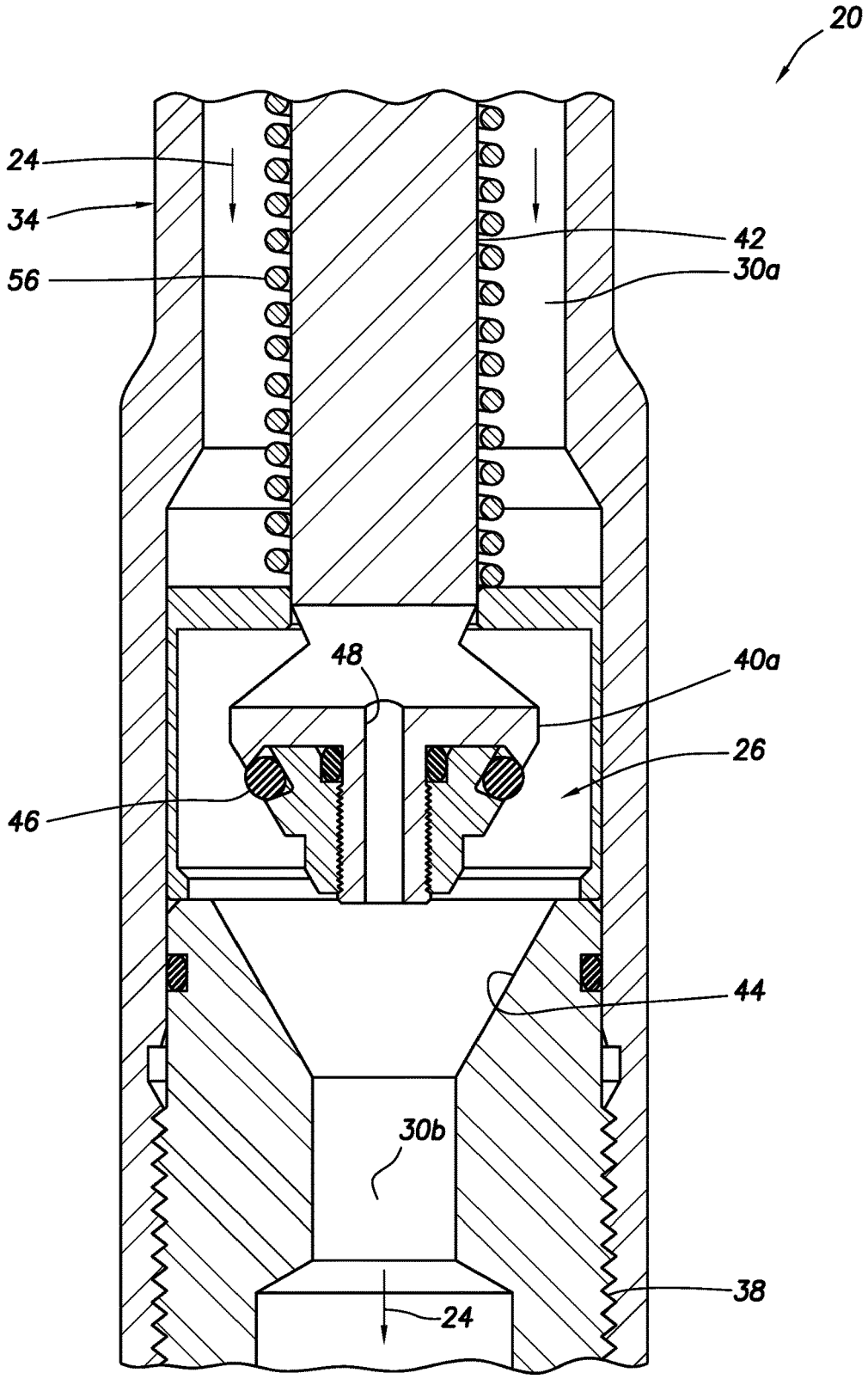
FIG. 12 is a representative cross-sectional view of a portion of another example of the circulating valve assembly.

Referring additionally now to FIG. 12, a portion of another example of the circulating valve assembly 20 is representatively illustrated. In this example, the closure member 40*a* of the operator valve 26 is provided with the opening 48. When the operator valve 26 is closed, the opening 48 permits a relatively small amount of the fluid flow 24 to pass through the closure member 40*a*.

Thus, in a bypass configuration of the FIG. 12 example, in which the bypass valve 28 is open and the operator valve 26 is closed, most of the fluid flow 24 will be directed from the upper flow passage section 30*a* to the annulus 32, but some of the fluid flow will still be permitted to pass to the lower flow passage section 30*b*.

Referring additionally now to FIGS. 13-19, another example of the circulating valve assembly 20 is representatively illustrated. The FIGS. 13-19 example is similar in many respects to the FIGS. 7-12 example described above, and so the same reference numbers are used in FIGS. 13-19 to indicate similar components of the circulating valve assembly 20.

The FIGS. 13-19 circulating valve assembly 20 differs significantly from the FIGS. 7-12 circulating valve assembly in the configuration of the index mechanism 84. Otherwise, the FIGS. 13-19 circulating valve assembly 20 operates in substantially the same manner as the FIGS. 7-12 circulating valve assembly.

Figure 13:
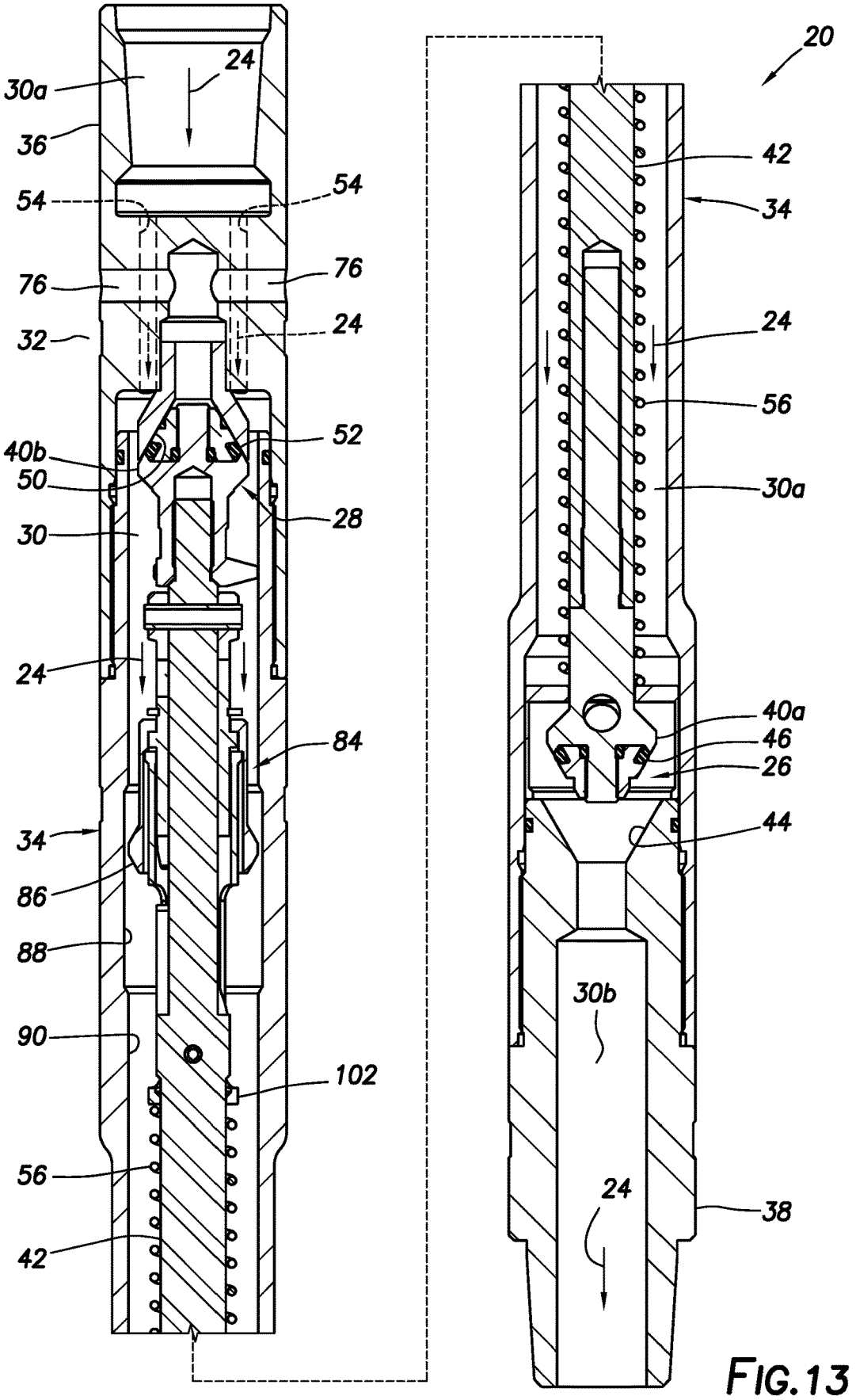
FIG. 13 is a representative cross-sectional view of another example of the circulating valve assembly, the circulating valve assembly being depicted in a run-in, operating configuration.

As depicted in FIG. 13, the circulating valve assembly 20 is in the run-in, operating configuration. The operator valve 26 is open (the seat 44 is spaced apart from the sealing surface 46 of the closure member 40*a*) and the bypass valve 28 is closed (the seat 50 is sealingly engaged by the sealing surface 52 of the closure member 40*b*). The fluid flow 24 can pass longitudinally through the flow passage 30 between the upper and lower sections 30*a,b*.

The flow restrictor 86 is positioned in the radially enlarged recess 88 in the housing assembly 34. The biasing device 56 biases the operator mandrel 42 longitudinally upward toward a closed position of the bypass valve 28 and an open position of the operator valve 26. This configuration is similar to that depicted in FIG. 7 and described above.

Figure 14:
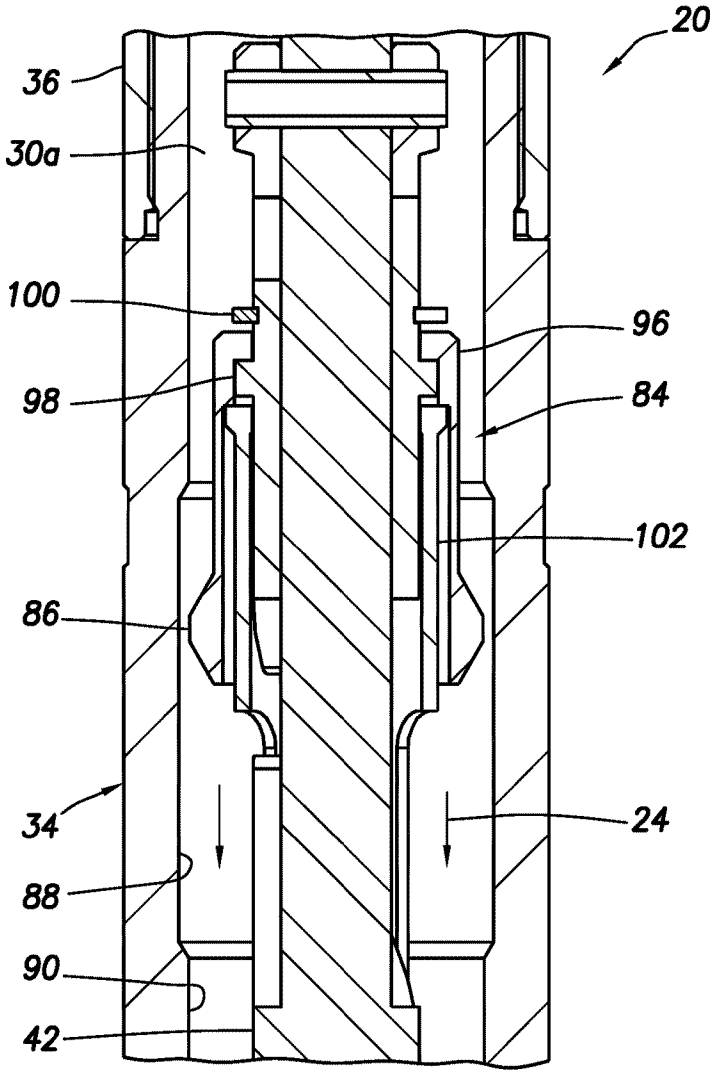
FIG. 14 is a representative cross-sectional view of an index mechanism of the FIG. 13 circulating valve assembly.

Referring now to FIG. 14, a portion of the circulating valve assembly 20 including the index mechanism 84 is representatively illustrated. The circulating valve 20 is in the run-in, operating configuration, so the fluid flow 24 passes through the upper flow passage section 30*a* and through the annular space between the flow restrictor 86 and the radially enlarged recess 88.

In this example, the flow restrictor 86 is formed on an outer sleeve 96 secured to an index sleeve 98 of the index mechanism 84 with a snap ring 100. Thus, the outer sleeve 96 and the flow restrictor 86 formed thereon displace with the index sleeve 98 relative to the operator mandrel 42. Another sleeve 102 is retained radially between the outer sleeve 96 and the index sleeve 98.

Figure 15:
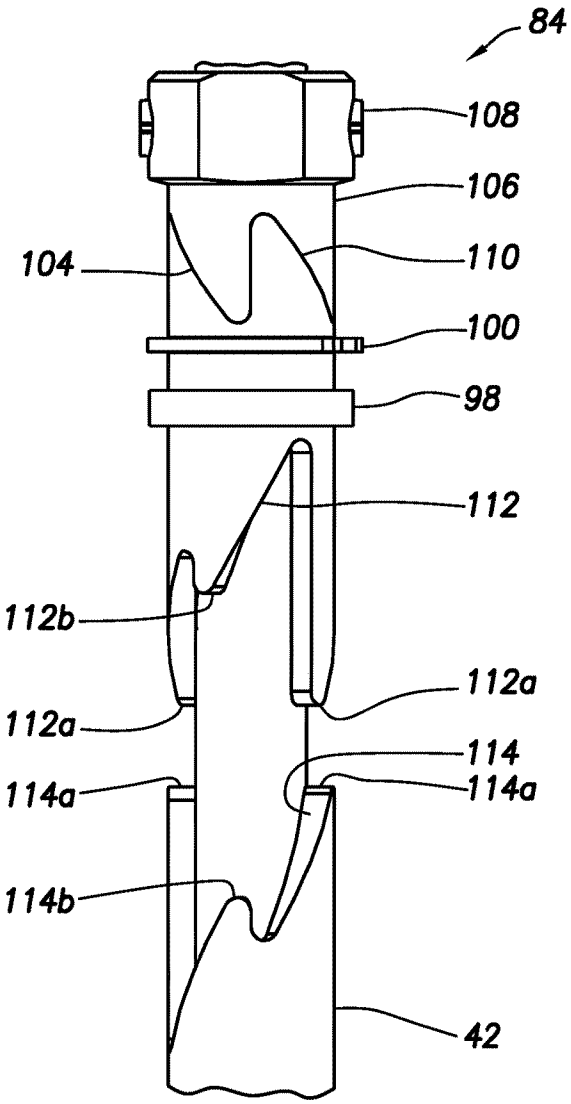
FIG. 15 is a representative side view of an index sleeve and operator mandrel of the circulating valve assembly.

Referring now to FIG. 15, certain components of the index mechanism 84 are representatively illustrated, apart from the remainder of the circulating valve assembly 20. These components are depicted with the circulating valve assembly 20 in the run-in, operating configuration.

In this example, the index mechanism 84 includes an upper index profile 104 formed on a lower end of a ratchet sleeve 106 secured to the operator mandrel 42 with a pin 108. A complementarily shaped upper index profile 110 is formed on an upper end of the index sleeve 98.

A lower index profile 112 is formed on a lower end of the index sleeve 98. A complimentarily shaped index profile 114 is formed on the operator mandrel 42.

The upper index profiles 104, 110 include mating inclined surfaces that tend to rotate the index sleeve 98 in a clockwise direction (as viewed from above) when the index sleeve engages and displaces upward relative to the ratchet sleeve 106. Similarly, the lower index profiles 112, 114 include mating inclined surfaces that tend to rotate the index sleeve 98 in a clockwise direction when the index sleeve engages and displaces downward relative to the operator mandrel 42.

However, note that the index profile 112 has two lower legs 112*a* that extend further downward than two lower legs 112*b* (only one of which is visible in FIG. 15). Similarly, the index profile 114 has two upper legs 114*a* that extend further upward than two upper legs 114*b* (only one of which is visible in FIG. 15). Other numbers of upper and lower legs may be used on index profiles in other examples.

When the index profiles 112, 114 are fully engaged with each other (e.g., when the index sleeve 98 has been displaced downward relative to the operator mandrel 42 as described more fully below), the index sleeve 98 will be in one of two longitudinal positions relative to the operator mandrel. Which of the two longitudinal positions the index sleeve 98 is in relative to the operator mandrel 42 is determined by the rotational orientation of the legs 112*a,b* relative to the legs 114*a,b*.

Referring again to FIG. 14, note that the fluid flow 24 through the annulus between the flow restrictor 86 and the radially enlarged recess 88 results in a pressure differential across the flow restrictor that tends to bias the flow restrictor in a downward direction (as viewed in the drawings). The biasing device 56 exerts an upwardly biasing force against a lower end of the sleeve 102 (see FIG. 13). Thus, if the flow rate of the fluid flow 24 is not sufficient to produce a great enough pressure differential across the flow restrictor 86 to overcome the upwardly biasing force exerted by the biasing device 56, the sleeve 102 and index sleeve 98 will be in an upper position relative to the operator mandrel 42 as depicted in FIG. 15, with the upper index profiles 104, 110 fully engaged with each other.

If the flow rate of the fluid flow 24 is sufficient to produce a great enough pressure differential across the flow restrictor 86 to overcome the upwardly biasing force exerted by the biasing device 56, the sleeve 102 and index sleeve 98 will displace downward relative to the operator mandrel 42, so that the lower index profiles 112, 114 profiles are engaged with each other. The rotational position of profiles 112, 114 relative to each other will determine how far the index sleeve 98 displaces downward relative to the operator mandrel 42. This is similar to the manner in which the downward displacement distance of the flow restrictor 86 relative to the operator mandrel 42 is determined by whether the pins 94 are received in the shorter profile legs 92*b* or the longer profile legs 92*d* in the FIGS. 7-12 example as described above.

Figure 16:
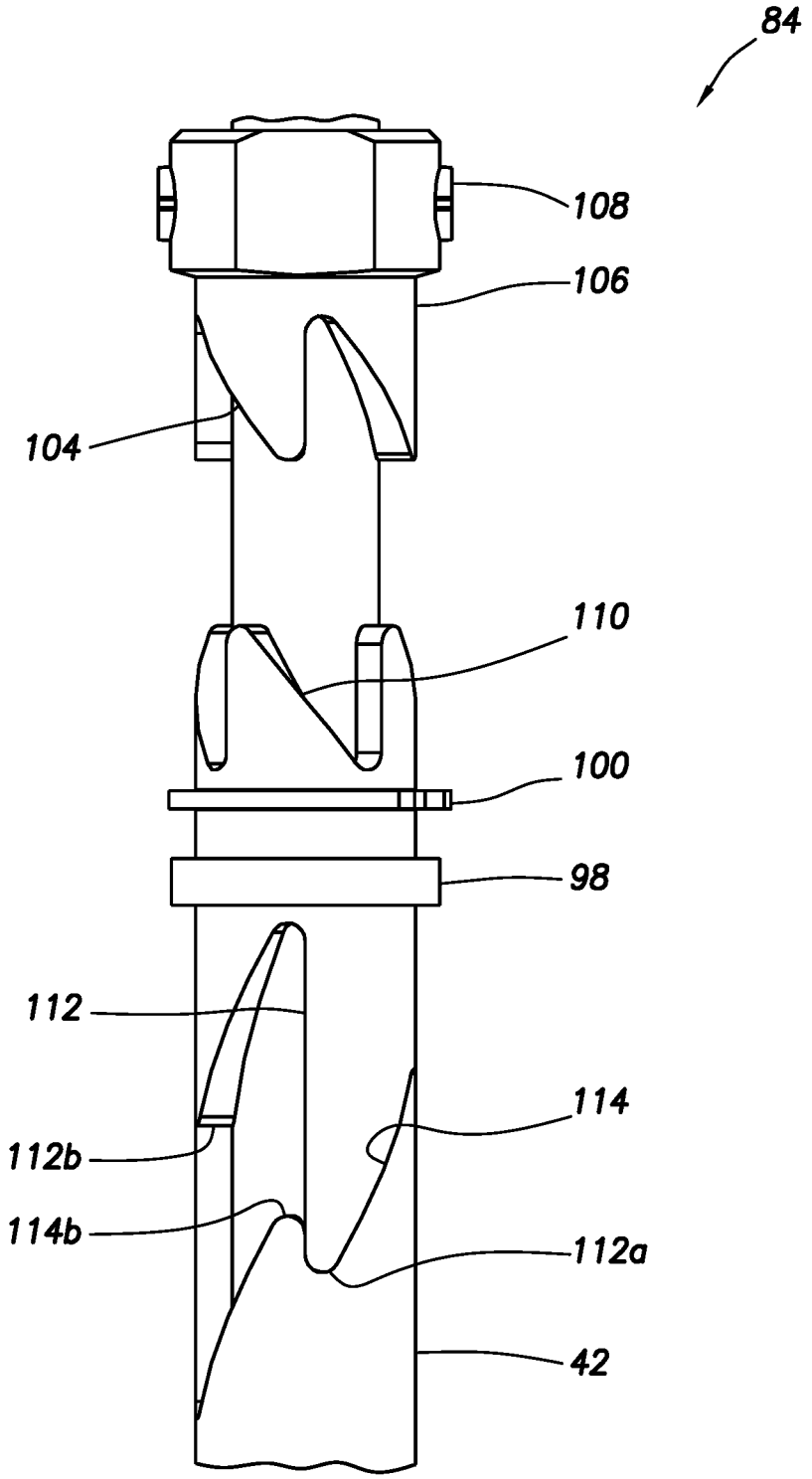
FIG. 16 is a representative side view of the index sleeve and operator mandrel depicted in an operating configuration.

Referring now to FIG. 16, components of the index mechanism 84 are representatively illustrated. In this view, the index sleeve 98 is displaced downward, so that the lower index profiles 112, 114 are engaged. This configuration is achieved by increasing the flow rate of the fluid flow 24, thereby increasing the pressure differential across the flow restrictor 86. When the flow rate and resulting pressure differential are increased to a sufficient level, the upwardly biasing force exerted by the biasing device 56 on the lower end of the sleeve 102 is overcome, and the index sleeve 98 displaces downward relative to the operator mandrel 42.

When the lower profiles 112, 114 engage each other, the inclined surfaces of the profiles cause the index sleeve 98 to rotate clockwise somewhat. As depicted in FIG. 16, eventually the longer legs 112*a* of the index profile 112 "bottom out" between the legs 114*a,b* of the index profile 114 (although only one of the legs 114*b* is visible in FIG. 16). The flow restrictor 86 remains positioned in the radially enlarged recess 88 in the housing assembly 34 (see FIG. 14) with the index profiles 112, 114 engaged in this manner.

A subsequent decrease in the flow rate of the fluid flow 24 can then allow the biasing device 56 to displace the index sleeve 98 upward relative to the operator mandrel 42 (the pressure differential across the flow restrictor 86 decreases when the flow rate is decreased). As a result, the index mechanism will return to the FIG. 15 configuration, except that the index sleeve 98 will be rotated clockwise relative to the operator mandrel 42. As described above, the index sleeve 98 is rotated clockwise somewhat when the index sleeve displaces downward and the lower index profiles 112, 114 engage each other due to an increase in the flow rate. The index sleeve 98 is also rotated clockwise somewhat when the index sleeve displaces upward and the upper index profiles 104, 110 engage each other due to a decrease in the flow rate.

Figure 17:
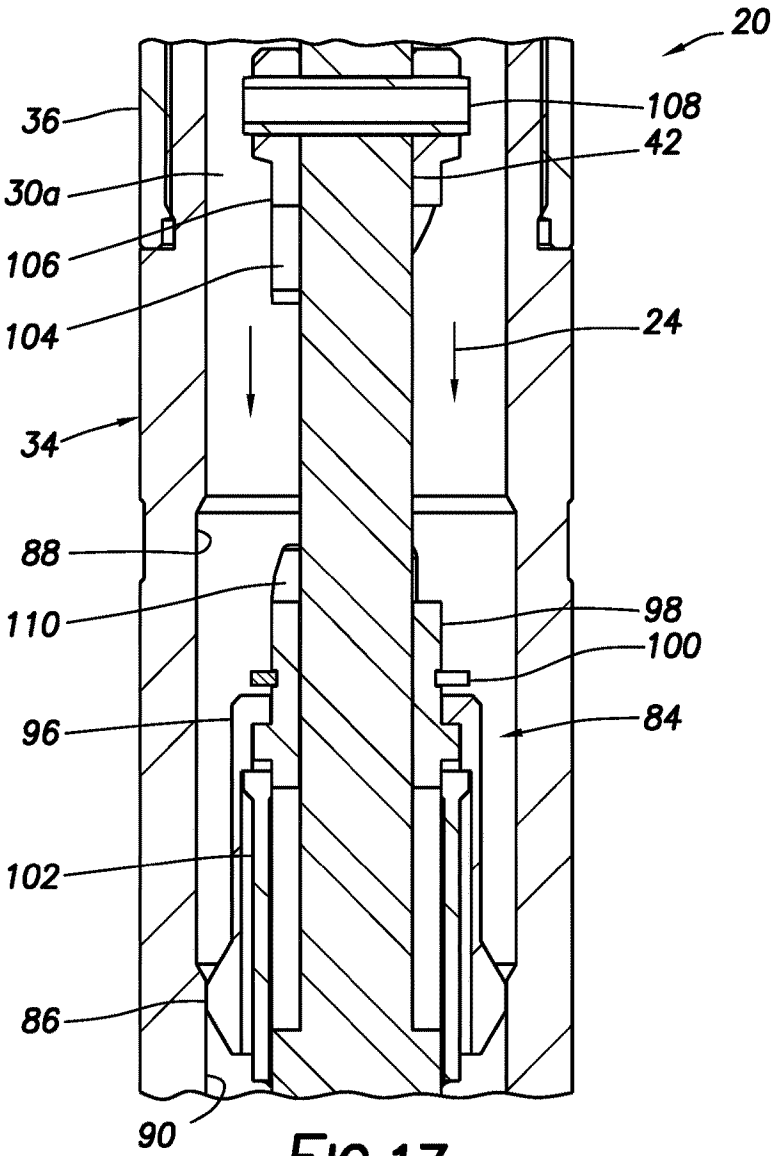
FIG. 17 is a representative cross-sectional view of the index mechanism depicted in an indexed, increased flow rate configuration.

Referring now to FIG. 17, the index mechanism 84 portion of the circulating valve assembly 20 is depicted after the flow rate of the fluid flow 24 has again been increased. Due to the increased flow rate, the pressure differential across the flow restrictor 86 is also increased, so that the biasing force exerted by the biasing device 56 is overcome and the flow restrictor, index sleeve 98 and sleeve 102 are displaced downward relative to the operator mandrel 42.

The flow restrictor 86 is now positioned in the reduced diameter bore 90, which thereby reduces a flow area of the annulus between the flow restrictor and the housing assembly 34. The pressure differential across the flow restrictor 86 is, thus, increased for a given flow rate of the fluid flow 24 through the annulus, as compared to the configuration (see FIG. 14) in which the flow restrictor is positioned in the radially enlarged recess 88 in the housing assembly 34.

Figure 18:
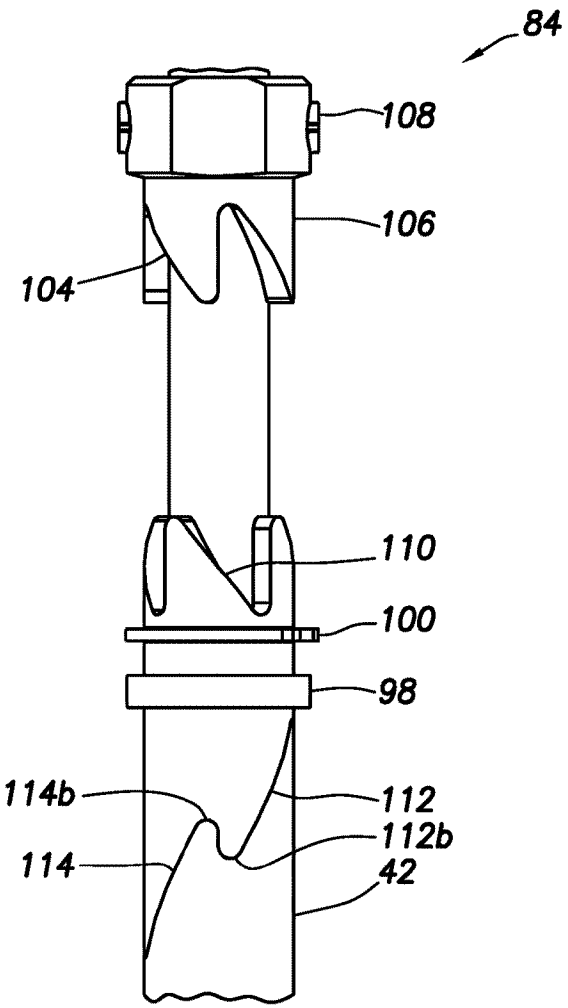
FIG. 18 is a representative side view of the index profile and operator mandrel depicted in the indexed, increased flow rate configuration.

Components of the index mechanism 84 are representatively illustrated in FIG. 18 corresponding to the configuration of FIG. 17. Note that the lower index profiles 112, 114 are now fully engaged, so that the index sleeve 98 is permitted to displace further downward relative to the operator mandrel 42, as compared to the configuration of FIG. 16. In addition, the index sleeve 98 is again rotated clockwise somewhat when the lower index profiles 112, 114 engage each other.

Figure 19:
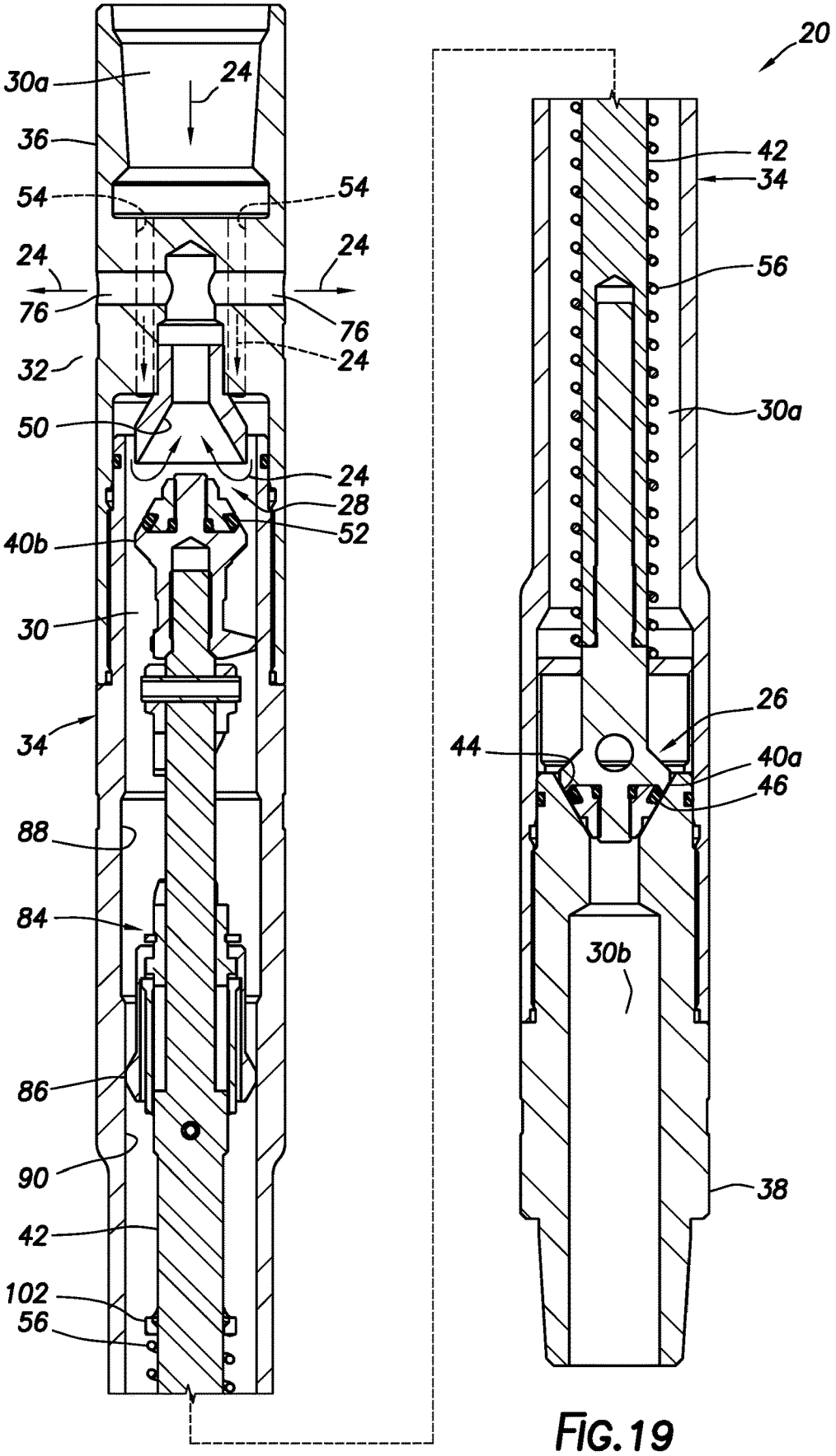
FIG. 19 is a representative cross-sectional view of the circulating valve assembly depicted in a bypass configuration.

Referring now to FIG. 19, the circulating valve assembly 20 is representatively illustrated in a bypass configuration that corresponds to the FIGS. 17 & 18 configurations in which the flow restrictor 86 is positioned in the bore 90. The pressure differential across the flow restrictor 86 is sufficient to overcome the upwardly biasing force exerted by the biasing device 56. As a result, the operator mandrel 42 is displaced downward relative to the FIG. 13 operating configuration.

The operator valve 26 now blocks flow from the upper flow passage section 30*a* to the lower flow passage section 30*b*. The bypass valve 28 is now open, thereby permitting flow from the upper flow passage section 30*a* to the external annulus 32. Note that, in its closed configuration, the operator valve 26 could permit some flow from the upper flow passage section 30*a* to the lower flow passage section 30*b* (such as, utilizing the opening 48 as depicted in FIG. 12).

The circulating valve 20 can be returned to the FIG. 13 operating configuration by decreasing the flow rate of the fluid flow 24, so that the upwardly biasing force exerted by the biasing device 56 will displace the operator mandrel 42 (and the indexing mechanism 84 thereon) upward. The upward displacement of the index sleeve 98 relative to the operator mandrel 42 will again cause the upper index profiles 104, 110 to engage each other, thereby rotating the index sleeve 98 clockwise somewhat relative to the operator mandrel as described above (see FIG. 15).

The bypass configuration of FIG. 19 may be useful in the FIG. 1 system 10 and method when it is desired to flush the annulus 32 of debris, sand, etc., or to displace fluid from the annulus. Note that only a decrease in flow rate of the fluid flow 24, followed by an increase in the flow rate, is required to switch the circulating valve assembly 20 from the operating configuration to the bypass configuration of FIG. 19. Similarly, only a decrease in flow rate of the fluid flow 24, followed by an increase in the flow rate, is required to switch the circulating valve assembly 20 from the bypass configuration of FIG. 19 back to the operating configuration.

In this example, the profiles 104, 110, 112, 114 are configured so that only a single set of a flow rate decrease (e.g., so that the flow rate is less than a predetermined level) followed by a flow rate increase (e.g., so that the flow rate is greater than the predetermined level) is required to switch the circulating valve assembly 20 from the bypass to the operating configuration, or from the operating configuration to the bypass configuration. In other examples, the profiles 104, 110, 112, 114 may be configured to require multiple sets of flow rate decreases and increases, or to require a different number of flow rate increases than the number of flow rate decreases, to switch between configurations of the circulating valve assembly 20.

Figure 20:
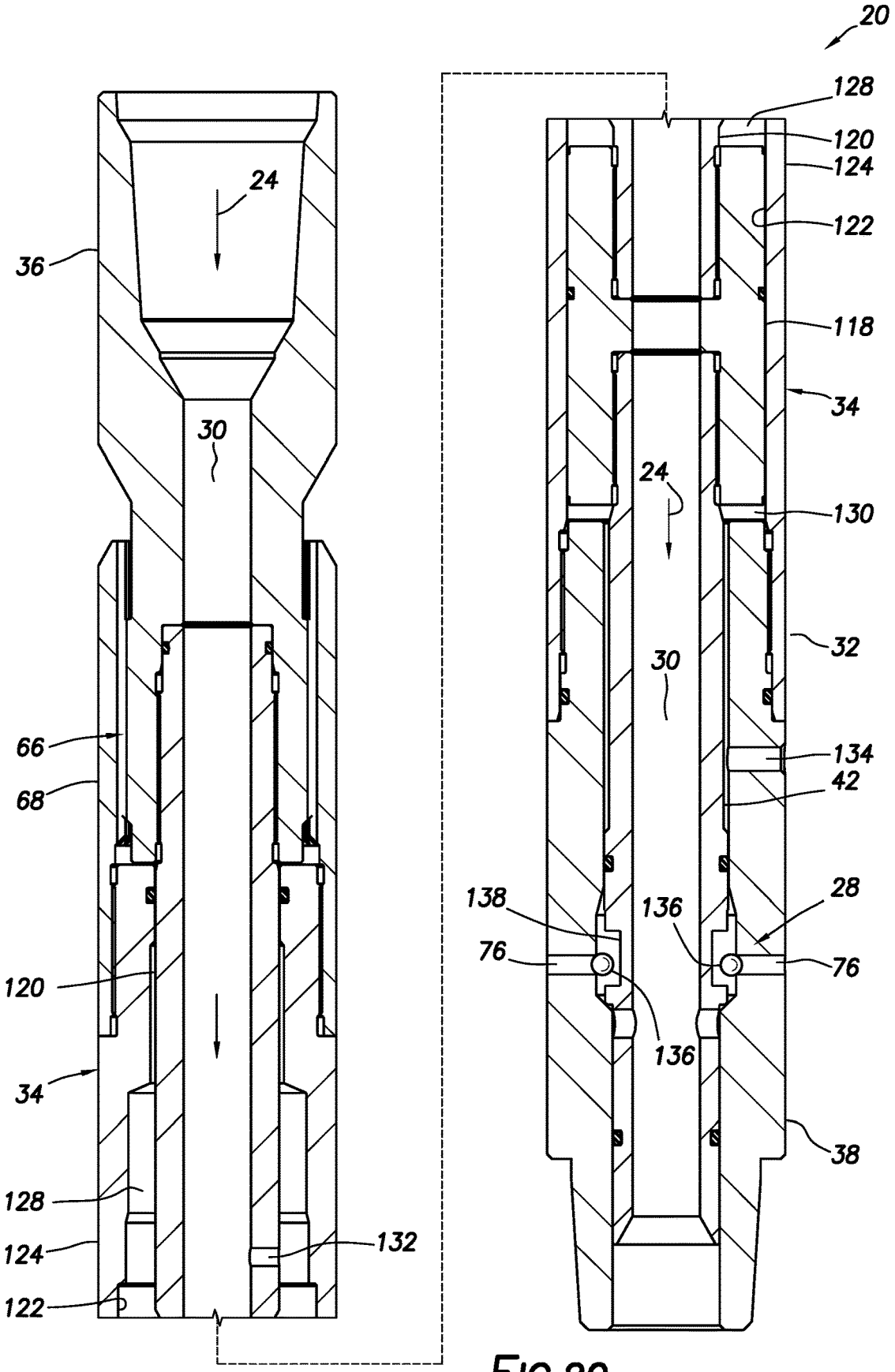
FIG. 20 is a representative cross-sectional view of another example of the circulating valve assembly depicted in a compressed, operating configuration.
Figure 21:
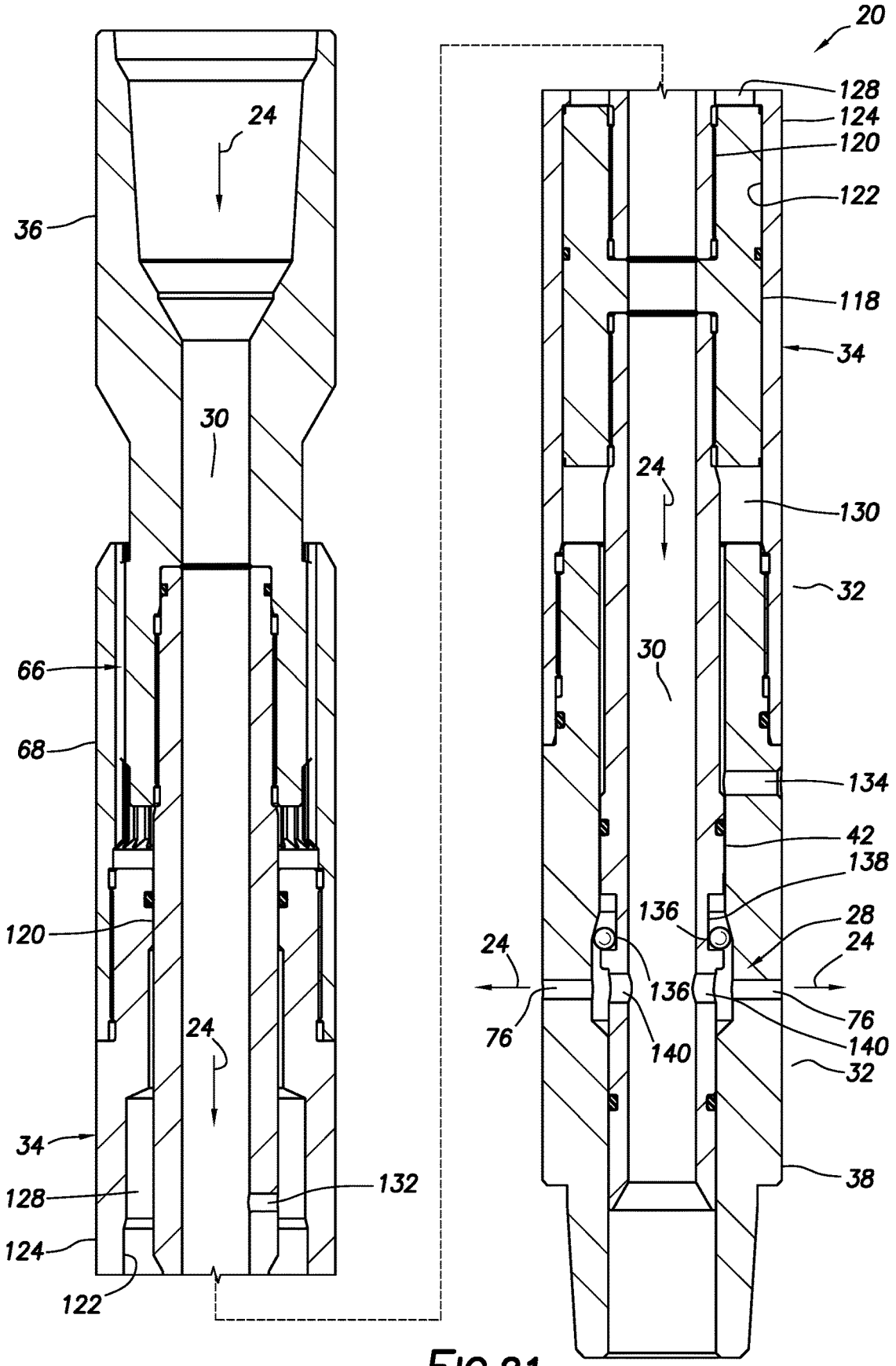
FIG. 21 is a representative cross-sectional view of the FIG. 20 circulating valve assembly depicted in an elongated, bypass configuration.

Referring additionally now to FIGS. 20 & 21, another configuration of the circulating valve assembly 20 is representatively illustrated. Components of the FIGS. 20 & 21 circulating valve assembly 20 that are similar to those described above are indicated in FIGS. 20 & 21 using the same reference numbers.

The FIGS. 20 & 21 example differs substantially from the other circulating valve assembly 20 examples described above in that the FIGS. 20 & 21 circulating valve assembly does not include the operator valve 26. Thus, the fluid flow 24 is always permitted longitudinally through the flow passage 30. The bypass valve 28 can be opened when it is desired to allow some of the fluid flow 24 to pass outward through the ports 76 to the external annulus 32.

The circulating valve assembly 20 is depicted in a longitudinally compressed operating configuration in FIG. 20. The bypass valve 28 is closed, thereby blocking flow from the flow passage 30 to the external annulus 32. In this configuration, the fluid flow 24 passes through the flow passage 30 to the bottom hole assembly 22, for example, to enable operation of the well tool 18 in the FIG. 1 system 10.

Note that the circulating valve assembly 20 includes the splined connection 66. In this example, the splined connection 66 permits relative longitudinal displacement between the upper connector housing 36 and the remainder of the outer housing assembly 34. The upper connector housing 36 is connected to the operator mandrel 42, so the operator mandrel is also permitted to displace longitudinally relative to the remainder of the outer housing assembly 34 with the upper connector. However, the splined connection prevents relative rotation between the upper connector housing 36 and the outer housing 68.

The operator mandrel 42 is in tubular form in this example, so that the flow passage 30 extends through the operator mandrel. An annular piston 118 is connected at an upper end of the operator mandrel 42, and a tubular upper mandrel 120 is connected between the piston and the upper connector housing 36.

The piston 118 is sealingly received in a bore 122 formed in an outer housing 124 of the housing assembly 34, and the upper mandrel 120 is sealingly received in a smaller diameter bore 126 formed in the outer housing 124. An annular chamber 128 is formed radially between the outer housing 124 and the upper mandrel 120, and longitudinally between the piston 118 and an upper end of the outer housing 124. Another annular chamber 130 is formed radially between the operator mandrel 42 and the outer housing 124, and longitudinally between the piston 118 and the lower connector housing 38. The chambers 128, 130 are positioned on opposite longitudinal sides of the piston 118.

The chamber 128 is in fluid communication with the flow passage 30 via an opening 132 formed through a sidewall of the upper mandrel 120. The chamber 130 is in fluid communication with the external annulus 32 via an opening 134 formed through a sidewall of the lower connector housing 38. Thus, a pressure differential across the piston 118 is essentially the same as a pressure differential between the flow passage 30 and the external annulus 32.

In the operating configuration of FIG. 20, pressure in the flow passage 30 is greater than pressure in the external annulus 32, due to fluid friction, flow restrictions, etc., as the fluid flow 24 passes through the bottom hole assembly 22 downstream of the circulating valve assembly 20. Thus, pressure in the chamber 128 is greater than pressure in the chamber 130. As a result, the piston 118 (and the connected operator mandrel 42, upper mandrel 120 and upper connector housing 36) are biased downward relative to the outer housings 68, 124 and lower connector housing 38, due to the pressure differential across the piston.

Thus, once the circulating valve assembly 20 is in the operating configuration and sufficient fluid flow 24 is maintained through the flow passage 30, it is not necessary for a compressive force to be applied to the circulating valve assembly 20 for it to remain in the operating configuration. For example, the circulating valve assembly 20 can be placed in the operating configuration by applying a compressive force to the circulating valve assembly (e.g., by slacking off weight on the tubular string 12 at surface while a lower end of the tubular string abuts a distal end of the wellbore 14). The fluid flow 24 through the flow passage 30 can then be used to operate the well tool 18, for example, in order to rotate the drill bit 16 and thereby further drill the wellbore 14.

If sufficient fluid flow 24 is then maintained through the flow passage 30, the compressive force can be relieved and a tensile force can be applied to the circulating valve assembly 20 (for example, by picking up on the tubular string 12 at surface when the tubular string is retrieved from the well), without causing the operator mandrel 42 to displace upward relative to the housing assembly 34. The pressure differential from the chamber 128 to the chamber 130 will continue to bias the piston 118 downward, thereby maintaining the circulating valve assembly 20 in the operating configuration, as long as sufficient fluid flow 24 is maintained.

The sufficient fluid flow 24 may, for example, comprise a flow rate sufficient to operate the well tool 18, although this is not necessary in keeping with the scope of this disclosure. The sufficient flow rate is a flow rate greater than a predetermined level determined, for example, by piston areas of the piston 118, fluid friction through the bottom hole assembly 22, etc.

The bypass valve 28 in this example includes closure members 136 in the form of spheres, balls or other types of plugs. The closure members 136 block fluid flow from the flow passage 30 to the external annulus 32 via the ports 76. The pressure differential from the flow passage 30 to the external annulus 32 maintains each of the closure members 136 in a position blocking flow through a respective one of the ports 76 while the fluid flow 24 is maintained through the flow passage 30. In other examples, other types of closure members (such as, one or more flappers, sliding sleeves, etc.) may be used instead of the closure members 136.

Note that the closure members 136 are partially received in an external radially reduced recess 138 formed on the operator mandrel 42. The recess 138 is positioned on the operator mandrel 42 so that, if the operator mandrel is displaced upward relative to the lower connector housing 38, the operator mandrel will cause the closure members 136 to be displaced upward and away from the ports 76. In another example, the closure members 136 could be received in slots, grooves or other types of recesses formed on the operator mandrel 42.

Referring additionally now to FIG. 21, the circulating valve assembly 20 is representatively illustrated in an elongated, bypass configuration. In this configuration, the bypass valve 28 is open and the fluid flow 24 is permitted to pass from the flow passage 30 to the external annulus 32 via the ports 76.

The FIG. 21 bypass configuration can be achieved by applying a tensile longitudinal force to the circulating valve assembly 20 while the flow rate of the fluid flow 24 is reduced (e.g., less than the predetermined flow rate), so that the pressure differential across the piston 118 is insufficient to maintain the circulating valve assembly in its compressed, operating configuration. Once the circulating valve assembly 20 is in the elongated, bypass configuration of FIG. 21, the flow rate of the fluid flow 24 can be increased.

The bypass valve 28 is opened in response to the operator mandrel 42 being displaced upward relative to the lower connector housing 38 of the housing assembly 34. The upward displacement of the operator mandrel 42 causes the closure members 136 to also be displaced upward, so that they no longer block flow outward through the ports 76. Openings 140 formed through a sidewall of the operator mandrel 42 permit fluid flow 24 from the flow passage 30 to the ports 76 when the closure members 136 do not block the ports 76.

In this example, the closure members 136 preferably comprise a relatively hard, abrasion- and erosion-resistant material (such as, tungsten carbide or another carbide material). In addition, the ports 76 and openings 140 may be lined with, or extend through, a similar relatively hard, abrasion- and erosion-resistant material.

If desired, the circulating valve assembly 20 can be returned to the FIG. 20 compressed, operating configuration by applying a longitudinally compressive force to the circulating valve assembly (for example, by slacking off on the tubular string 12 at surface. The operator mandrel 42 will displace downward relative to the lower connector housing 38, thereby allowing the closure members 136 to again engage and block flow through the ports 76.

It may now be fully appreciated that the above disclosure provides significant advancements to the art of performing well operations while preventing accumulation of debris and other materials in an annulus surrounding a tubular string. In the FIGS. 2-6 example, the circulating valve assembly 20 can be actuated between operating and bypass configurations by applying compressive or tensile forces to the circulation valve assembly. In the FIGS. 7-12 example, the circulating valve assembly 20 can be actuated between operating and bypass configurations by alternating decreases and increases in a flow rate through the circulating valve assembly.

A method of performing an operation in a subterranean well is provided to the art by the above disclosure. In one example, the method can comprise: closing a bypass valve 28 of a circulating valve assembly 20, thereby blocking fluid communication between an internal flow passage 30 of the circulating valve assembly 20 and an annulus 32 external to the circulating valve assembly 20; and then applying a first longitudinally tensile force to the circulating valve assembly 20 while a fluid flow 24 passes longitudinally through the flow passage 30, the bypass valve 28 remaining closed when the longitudinally tensile force is applied to the circulating valve assembly 20.

In various examples described herein:

The method may include applying a second longitudinally tensile force to the circulating valve assembly 20 while a flow rate of the fluid flow 24 is less than a predetermined level, thereby opening the bypass valve 28.

The method may include reducing a flow rate of the fluid flow 24 to less than a predetermined level, thereby opening the bypass valve 28.

The method may include opening an operator valve 26 of the circulating valve assembly 20, thereby permitting the fluid flow 24 to pass longitudinally through the circulating valve assembly 20 via the flow passage 30 while the bypass valve 28 is closed.

The step of applying the first longitudinally tensile force may include the operator valve 26 remaining open when the first longitudinally tensile force is applied to the circulating valve assembly 20.

The step of opening the operator valve 26 may include applying a longitudinally compressive force to the circulating valve assembly 20.

The method may include operating a well tool 18 in response to the fluid flow 24, the well tool 18 being connected downstream of the circulating valve assembly 20, and the well tool 18 being selected from the group consisting of a fluid motor, a vibratory tool, a stabilizer, a steering tool and a reamer.

The step of applying the first longitudinally tensile force may include elongating the circulating valve assembly 20.

Another method of performing an operation in a subterranean well is provided to the art by the above disclosure. In one example, the method can comprise: deploying a circulating valve assembly 20 into the well, the circulating valve assembly 20 having an operating configuration in which fluid flow 24 through the circulating valve assembly 20 is directed to a well tool 18 connected downstream of the circulating valve assembly 20, and a bypass configuration in which the fluid flow 24 can pass through a sidewall of the circulating valve assembly 20 to an annulus 32 external to the circulating valve assembly 20; applying a longitudinally compressive force to the circulating valve assembly 20, thereby placing the circulating valve assembly 20 in the operating configuration; and then applying a first longitudinally tensile force to the circulating valve assembly 20, the circulating valve assembly 20 remaining in the operating configuration after the first longitudinally tensile force has been applied.

In various examples described herein:

The step of applying the longitudinally compressive force may include decreasing a length of the circulating valve assembly 20. The step of applying the first longitudinally tensile force may include increasing a length of the circulating valve assembly 20.

The step of applying the first longitudinally tensile force may include maintaining a flow rate of the fluid flow 24 greater than a predetermined level while the longitudinally tensile force is applied to the circulating valve assembly 20.

The method may include applying a second longitudinally tensile force to the circulating valve assembly 20 while the flow rate of the fluid flow 24 is less than the predetermined level, thereby placing the circulating valve assembly 20 in the bypass configuration.

The step of placing the circulating valve assembly 20 in the bypass configuration may include displacing at least one closure member 40, 136 that blocks the fluid flow 24 through at least one port 76 formed through the sidewall.

A biasing device 56 may bias the closure member 40 toward a closed position of a bypass valve 28 of the circulating valve assembly 20 when the longitudinally compressive force is applied to the circulating valve assembly 20, and the biasing device 56 may bias the closure member 40 toward an open position of an operator valve 26 of the circulating valve assembly 20 when the first and second longitudinally tensile forces are applied to the circulating valve assembly 20.

The above disclosure also provides to the art a method of performing an operation in a subterranean well, in which the method can include: directing fluid flow 24 longitudinally through a well tool 18 connected in a tubular string 12 downstream of a longitudinally compressed circulating valve assembly 20, thereby causing the well tool 18 to operate; and longitudinally elongating the circulating valve assembly 20 while the fluid flow 24 is ceased, and then increasing the fluid flow 24, thereby causing the fluid flow 24 after the elongating step to pass outwardly through a sidewall of a housing 36 of the circulating valve assembly 20 to an annulus 32 external to the circulating valve assembly 20.

In any of the examples described herein:

The well tool 18 may comprise at least one of a fluid motor, a vibratory tool, a stabilizer, a steering tool and a reamer. The step of causing the well tool 18 to operate may include operating the fluid motor, the vibratory tool, the stabilizer, the steering tool and/or the reamer.

The elongating step may include causing a bypass valve 28 of the circulating valve assembly 20 to open, thereby permitting the fluid flow 24 to pass from a central longitudinal flow passage 30 of the circulating valve assembly 20 to the external annulus 32 via a port 76 in the circulating valve assembly housing 36.

The elongating step may include causing an operator valve 26 of the circulating valve assembly 20 to close, thereby blocking the fluid flow 24 between first and second sections 30*a,b* of the flow passage 30.

The permitting step may include permitting the fluid flow 24 to pass from the flow passage first section 30*a* to the external annulus 32 via the bypass valve 28.

The method may include longitudinally compressing the circulating valve assembly 20 prior to the directing step, thereby closing the bypass valve 28 and opening the operator valve 26. The fluid flow 24 may be ceased during the longitudinally compressing step.

The circulating valve assembly 20 may include a biasing device 56 that exerts a biasing force that biases an operator mandrel 42 between an operating position in which the bypass valve 28 is closed and the operator valve 26 is open, and a bypass position in which the bypass valve 28 is open and the operator valve 26 is closed.

The compressing step may include the biasing force biasing the operator mandrel 42 toward the operating position. The elongating step may include the biasing force biasing the operator mandrel 42 toward the bypass position.

Also provided to the art by the above disclosure is a circulating valve assembly 20 for use in a subterranean well. In one example, the circulating valve assembly 20 can include: a housing assembly 34 having a longitudinally compressed configuration and a longitudinally elongated configuration; a flow passage 30 extending longitudinally through the housing assembly 34; an operator valve 26 that selectively blocks flow between first and second sections 30*a,b* of the flow passage 30; and a bypass valve 28 that selectively blocks flow between the flow passage first section 30*a* and an exterior of the circulating valve assembly 20.

In any of the examples described herein:

The operator valve 26 may be open and the bypass valve 28 may be closed in the compressed configuration. The operator valve 26 may be closed and the bypass valve 28 may be open in the elongated configuration.

The circulating valve assembly 20 may include a biasing device 56 that exerts a biasing force that biases an operator mandrel 42 between an operating position in which the bypass valve 28 is closed and the operator valve 26 is open, and a bypass position in which the bypass valve 28 is open and the operator valve 26 is closed.

The biasing force may bias the operator mandrel 42 toward the operating position in the compressed configuration. The biasing force may bias the operator mandrel 42 toward the bypass position in the elongated configuration.

The circulating valve assembly 20 may include a closure member 40 secured to the operator mandrel 42, the closure member 40 comprising a first seal surface 52 for sealing engagement with a seat 50 of the bypass valve 28, and a second seal surface 46 for sealing engagement with a seat 44 of the operator valve 26.

The circulating valve assembly 20 may include a closure member 40 positioned longitudinally between a seat 50 of the bypass valve 28 and a seat 44 of the operator valve 26. The closure member 40 may be sealingly engaged with the bypass valve seat 50 in the compressed configuration, and the closure member 40 may be sealingly engaged with the operator valve seat 44 in the elongated configuration.

Some fluid flow 24 between the first and second flow passage sections 30*a,b* may be permitted in a closed configuration of the operator valve 26.

The circulating valve assembly 20 may include a splined connection 66 between first and second housings 38, 68 of the housing assembly 34.

Another method of performing an operation in a subterranean well is provided to the art by the above disclosure. In one example, the method can include: directing a fluid flow 24 through a well tool 18 connected in a tubular string 12 downstream of a circulating valve assembly 20, thereby causing the well tool 18 to operate; and decreasing then increasing a flow rate of the fluid flow 24, thereby causing the fluid flow 24 to pass outwardly through a sidewall of a housing assembly 34 of the circulating valve assembly 20 to an annulus 32 external to the circulating valve assembly 20.

In any of the examples described herein:

The decreasing then increasing step may be performed after the directing step. The decreasing then increasing step may be performed prior to the directing step.

The well tool 20 may include at least one of a fluid motor, a vibratory tool, a stabilizer, a steering tool and a reamer. The step of causing the well tool 18 to operate may include operating the fluid motor, the vibratory tool, the stabilizer, the steering tool and/or the reamer.

The decreasing then increasing step may include causing a bypass valve 28 of the circulating valve assembly 20 to open, thereby permitting the fluid flow 24 to pass from a central longitudinal flow passage 30 of the circulating valve assembly 20 to the external annulus 32.

The decreasing then increasing step may include diverting the fluid flow 24 from the well tool 18 to the external annulus 32.

The decreasing then increasing step may include closing an operator valve 26 that controls the fluid flow 24 longitudinally through the circulating valve assembly 20. The decreasing then increasing step may include opening a bypass valve 28 that controls the fluid flow 24 laterally through the housing assembly 34 sidewall.

The method may include decreasing then increasing the flow rate of the fluid flow 24, thereby closing a bypass valve 28 of the circulating valve assembly 20 and opening an operator valve 26 of the circulating valve assembly 20, the operator valve 26 controlling the fluid flow 24 between first and second sections 30*a,b* of a flow passage 30 extending longitudinally through the circulating valve assembly 20, and the bypass valve 28 controlling the fluid flow 24 between the flow passage first section 30*a* and the annulus 32 external to the circulating valve assembly 20.

The circulating valve assembly 20 may include an operator mandrel 42 reciprocably disposed in the housing assembly 34, and an index profile 92 that controls a longitudinal position of a flow restrictor 86 relative to the operator mandrel 42.

The decreasing then increasing step may include longitudinally displacing the flow restrictor 86 relative to the operator mandrel 42. The decreasing then increasing step may include reducing a flow area between the flow restrictor 86 and the housing assembly 34.

Also described above is a circulating valve assembly 20 for use in a subterranean well. In one example, the circulating valve assembly 20 can include: a housing assembly 34; a flow passage 30 extending longitudinally through the housing assembly 34; an operator valve 26 that controls fluid communication between first and second sections 30*a,b* of the flow passage 30; a bypass valve 28 that controls fluid communication between the flow passage first section 30*a* and an exterior of the circulating valve assembly 20; and an index mechanism 84 configured to vary a flow area of the flow passage 30.

In any of the examples described herein:

The circulating valve assembly 20 may include a flow restrictor 86 that restricts fluid communication through the flow passage 30. The index mechanism 84 may control a longitudinal position of the flow restrictor 86.

The flow area between the flow restrictor 86 and the housing assembly 34 in an operating configuration is greater than the flow area between the flow restrictor 86 and the housing assembly 34 in a bypass configuration. The operator valve 26 is open and the bypass valve 28 is closed in the operating configuration, and the operator valve 26 is closed and the bypass valve 28 is open in the bypass configuration.

The circulating valve assembly 20 may include an operator mandrel 42 reciprocably disposed in the housing assembly 34, a bypass valve closure member 40*b* secured at one end of the operator mandrel 42, and an operator valve closure member 40*a* secured at an opposite end of the operator mandrel 42.

The index mechanism 84 may include an index profile 92 formed on the operator mandrel 42.

The bypass valve closure member 40*b* may be configured to sealingly engage a seat 50 of the bypass valve 28, and the operator valve closure member 40*a* may be configured to sealingly engage a seat 44 of the operator valve 26.

The index mechanism 84 may control a longitudinal position of a flow restrictor 86 relative to the operator mandrel 42.

The flow restrictor 86 may be positioned longitudinally between the bypass valve closure member 40*b* and the operator valve closure member 40*a*.

The circulating valve assembly 20 may include a biasing device 56 that biases the flow restrictor 86, operator mandrel 42 and bypass valve closure member 40*b* toward an operating configuration in which the bypass valve closure member 40*b* sealingly engages a seat 50 of the bypass valve 28.

Some fluid communication between the first and second flow passage sections 30*a,b* may be permitted in a bypass configuration.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of performing an operation in a subterranean well, the method comprising:

closing a bypass valve of a circulating valve assembly, thereby blocking fluid communication between an internal flow passage of the circulating valve assembly and an annulus external to the circulating valve assembly; and then applying a first longitudinally tensile force to the circulating valve assembly while a fluid flow passes longitudinally through the flow passage, the bypass valve remaining closed when the first longitudinally tensile force is applied to the circulating valve assembly.

2. The method of claim 1, further comprising applying a second longitudinally tensile force to the circulating valve assembly while a flow rate of the fluid flow is less than a predetermined level, thereby opening the bypass valve.

3. The method of claim 1, further comprising reducing a flow rate of the fluid flow to less than a predetermined level, thereby opening the bypass valve.

4. The method of claim 1, further comprising opening an operator valve of the circulating valve assembly, thereby permitting the fluid flow to pass longitudinally through the circulating valve assembly via the flow passage while the bypass valve is closed.

5. The method of claim 4, in which the applying the first longitudinally tensile force comprises the operator valve remaining open when the first longitudinally tensile force is applied to the circulating valve assembly.

6. The method of claim 4, in which the opening the operator valve comprises applying a longitudinally compressive force to the circulating valve assembly.

7. The method of claim 1, further comprising operating a well tool in response to the fluid flow, the well tool being connected downstream of the circulating valve assembly, and the well tool being selected from the group consisting of a fluid motor, a vibratory tool, a stabilizer, a steering tool and a reamer.

8. The method of claim 1, in which the applying the first longitudinally tensile force comprises elongating the circulating valve assembly.

9. A method of performing an operation in a subterranean well, the method comprising:

deploying a circulating valve assembly into the well, the circulating valve assembly having an operating configuration in which fluid flow through the circulating valve assembly is directed to a well tool connected downstream of the circulating valve assembly, and a bypass configuration in which the fluid flow can pass through a sidewall of the circulating valve assembly to an annulus external to the circulating valve assembly;

applying a longitudinally compressive force to the circulating valve assembly, thereby placing the circulating valve assembly in the operating configuration; and then applying a first longitudinally tensile force to the circulating valve assembly, the circulating valve assembly remaining in the operating configuration after the first longitudinally tensile force has been applied.

10. The method of claim 9, in which the applying the longitudinally compressive force comprises decreasing a length of the circulating valve assembly.

11. The method of claim 9, in which the applying the first longitudinally tensile force comprises increasing a length of the circulating valve assembly.

12. The method of claim 9, in which the applying the first longitudinally tensile force comprises maintaining a flow rate of the fluid flow greater than a predetermined level while the longitudinally tensile force is applied to the circulating valve assembly.

13. The method of claim 12, further comprising applying a second longitudinally tensile force to the circulating valve assembly while the flow rate of the fluid flow is less than the predetermined level, thereby placing the circulating valve assembly in the bypass configuration.

14. The method of claim 13, in which the placing the circulating valve assembly in the bypass configuration comprises displacing at least one closure member, whereby the closure member no longer blocks the fluid flow through at least one port formed through the sidewall.

15. The method of claim 14, in which a biasing device biases the closure member toward a closed position of a bypass valve of the circulating valve assembly when the longitudinally compressive force is applied to the circulating valve assembly, and the biasing device biases the closure member toward an open position of an operator valve of the circulating valve assembly when the first and second longitudinally tensile forces are applied to the circulating valve assembly.

16. A method of performing an operation in a subterranean well, the method comprising:

directing fluid flow longitudinally through a well tool connected in a tubular string downstream of a longitudinally compressed circulating valve assembly, thereby causing the well tool to operate; and longitudinally elongating the circulating valve assembly while a flow rate of the fluid flow is less than a predetermined level, and then increasing the flow rate, thereby causing the fluid flow after the elongating to pass outwardly through a sidewall of a housing of the circulating valve assembly to an annulus external to the circulating valve assembly.

17. The method of claim 16, in which the well tool comprises at least one of the group consisting of a fluid motor, a vibratory tool, a stabilizer, a steering tool and a reamer, and in which the causing the well tool to operate comprises operating the at least one of the group consisting of the fluid motor, the vibratory tool, the stabilizer, the steering tool and the reamer.

18. The method of claim 16, in which the elongating comprises causing a bypass valve of the circulating valve assembly to open, thereby permitting the fluid flow to pass from a central longitudinal flow passage of the circulating valve assembly to the external annulus via a port in the circulating valve assembly housing.

19. The method of claim 18, in which the elongating further comprises causing an operator valve of the circulating valve assembly to close, thereby blocking the fluid flow between first and second sections of the flow passage.

20. The method of claim 19, in which the permitting comprises permitting the fluid flow to pass from the flow passage first section to the external annulus via the bypass valve.

21. The method of claim 19, further comprising longitudinally compressing the circulating valve assembly prior to the directing, thereby closing the bypass valve and opening the operator valve.

22. The method of claim 21, in which the fluid flow is ceased during the longitudinally compressing.

23. The method of claim 21, in which the circulating valve assembly comprises a biasing device that exerts a biasing force that biases an operator mandrel between an operating position in which the bypass valve is closed and the operator valve is open, and a bypass position in which the bypass valve is open and the operator valve is closed.

24. The method of claim 23, in which the compressing comprises the biasing force biasing the operator mandrel toward the operating position.

25. The method of claim 24, in which the elongating comprises the biasing force biasing the operator mandrel toward the bypass position.

26. A circulating valve assembly for use in a subterranean well, the circulating valve assembly comprising:

a housing assembly having a longitudinally compressed configuration and a longitudinally elongated configuration;

a flow passage extending longitudinally through the housing assembly;

an operator valve that selectively blocks flow between first and second sections of the flow passage;

a bypass valve that selectively blocks flow between the flow passage first section and an exterior of the circulating valve assembly; and a closure member positioned longitudinally between a seat of the bypass valve and a seat of the operator valve, in which the closure member is sealingly engaged with the bypass valve seat in the compressed configuration, and the closure member is sealingly engaged with the operator valve seat in the elongated configuration.

27. The circulating valve assembly of claim 26, in which the operator valve is open and the bypass valve is closed in the compressed configuration.

28. The circulating valve assembly of claim 26, in which the operator valve is closed and the bypass valve is open in the elongated configuration.

29. The circulating valve assembly of claim 26, further comprising a biasing device that exerts a biasing force that biases an operator mandrel between an operating position in which the bypass valve is closed and the operator valve is open, and a bypass position in which the bypass valve is open and the operator valve is closed.

30. The circulating valve assembly of claim 29, in which the biasing force biases the operator mandrel toward the operating position in the compressed configuration.

31. The circulating valve assembly of claim 30, in which the biasing force biases the operator mandrel toward the bypass position in the elongated configuration.

32. The circulating valve assembly of claim 29, in which the closure member is secured to the operator mandrel, the closure member comprising a first seal surface for sealing engagement with the seat of the bypass valve, and a second seal surface for sealing engagement with the seat of the operator valve.

33. The circulating valve assembly of claim 26, in which some fluid flow between the first and second flow passage sections is permitted in a closed configuration of the operator valve.

34. The circulating valve assembly of claim 26, further comprising a splined connection between first and second housings of the housing assembly.

* * * * *